US010550577B2

(12) United States Patent
Aboukhalil

(10) Patent No.: US 10,550,577 B2
(45) Date of Patent: Feb. 4, 2020

(54) FACE MOUNTING SYSTEM

(71) Applicant: Charbel Tannious Aboukhalil, Grand Terrace, CA (US)

(72) Inventor: Charbel Tannious Aboukhalil, Grand Terrace, CA (US)

( * ) Notice: Subject to any disclaimer, the term of this patent is extended or adjusted under 35 U.S.C. 154(b) by 0 days.

(21) Appl. No.: 15/679,076

(22) Filed: Aug. 16, 2017

(65) Prior Publication Data

US 2019/0055737 A1 Feb. 21, 2019

(51) Int. Cl.
*E04F 13/08* (2006.01)
*E04F 13/00* (2006.01)

(52) U.S. Cl.
CPC ..... *E04F 13/0803* (2013.01); *E04F 13/002* (2013.01); *E04F 13/0816* (2013.01); *E04F 13/0871* (2013.01)

(58) Field of Classification Search
CPC ... E04B 9/26; E04B 9/18; E04B 9/064; E04B 9/183; E04B 9/28; E04F 13/0812; E04F 13/081; E04F 13/0826; E04F 13/083; E04F 13/0805; E04F 13/0803; E04F 13/0871; E04F 13/002
See application file for complete search history.

(56) References Cited

U.S. PATENT DOCUMENTS 2,066,205 A * 12/1936 Keating ..... E04B 9/068 52/370
2,097,988 A * 11/1937 Ross ..... E04B 1/24 24/696
2,278,822 A * 4/1942 Benz ..... E04F 13/0803 52/480
3,188,774 A * 6/1965 McCorkle ..... E04F 13/0803 52/478
3,263,388 A * 8/1966 Bogert ..... E04B 9/064 248/327
4,432,182 A * 2/1984 Addie ..... E04B 9/26 52/480
5,349,802 A * 9/1994 Kariniemi ..... E04F 13/0812 52/478
6,205,733 B1 * 3/2001 LaLonde ..... E04B 9/067 52/506.07
6,430,885 B1 * 8/2002 Ito ..... E04F 13/0812 52/235
6,874,290 B1 * 4/2005 Bokan ..... E04F 13/0864 52/478
7,810,294 B2 * 10/2010 Maley ..... E04B 9/064 52/220.6

(Continued)

OTHER PUBLICATIONS

Fry Reglet Architectural Metals, Fry Reglet Graph System, A-L, retrieved from the Internet as early as Oct. 12, 2017, <URL:http://fryreglet.com/downloads_productresources/Graph/PDF/Standard_Details-1.25-Standard_Clip-.375_Panel.pdf >.

*Primary Examiner* — Ryan D Kwiecinski
*Assistant Examiner* — Matthew J Gitlin
(74) *Attorney, Agent, or Firm* — Stetina Brunda Garred & Brucker

(57) ABSTRACT

A face mounting system for mounting a plurality of panels to a surface of a wall is disclosed. The plurality of panels are attached to the surface of the wall by way of rails having hooks that engage a protrusion of the clips. The rails and the clips may be attached to the wall and the panels respectively or vice versa. Each of the panels may be attached and removed to the wall one at a time and in any order.

18 Claims, 27 Drawing Sheets

(56) References Cited

U.S. PATENT DOCUMENTS

| | | | | |
|---|---|---|---|---|
| 8,511,014 | B2 * | 8/2013 | Delforte | E04B 2/00 52/235 |
| 9,309,677 | B1 * | 4/2016 | Anic | E04F 13/0814 |
| 9,670,674 | B2 * | 6/2017 | St-Laurent | E04B 9/22 |
| 9,708,817 | B2 * | 7/2017 | Gestetner | E04F 13/081 |
| 2013/0205698 | A1 * | 8/2013 | Todd | E04F 13/0805 52/302.1 |

* cited by examiner

FACE MOUNTING SYSTEM

CROSS-REFERENCE TO RELATED APPLICATIONS

Not Applicable

STATEMENT RE: FEDERALLY SPONSORED RESEARCH/DEVELOPMENT

Not Applicable

BACKGROUND

The various embodiments and aspects described herein relate to a system for mounting panels to a wall.

Wall panels may be mounted to walls and other flat surfaces to protect the wall and for aesthetic purposes. However, there are certain deficiencies in current wall panel mounting systems.

Accordingly, there is a need in the art for an improved system for mounting wall panels to a wall.

BRIEF SUMMARY

A face mounting system for mounting a plurality of wall panels to a wall surface of a wall is disclosed herein. The plurality of wall panels may be attached to the wall surface of the wall by way of a plurality of rails and clips. The rails and clips may have a protrusion and hooks that engage the protrusion respectively or vice versa. The rails may be attached to the wall surface. The clips may be attached to the panels. In this configuration, each one of the panels may be attached and removed from the wall one by one and in any order.

More particularly, in an aspect of the disclosure, a structure having a wall defining a flat surface with a face mounting system mounted on the flat surface of the wall is disclosed. The face mounting system may include a plurality of panels. The structure may comprise the wall; the plurality of panels, each panel being between 6"×6" and 20"×20" and having a thickness between 5/16" and 1", each panel defining front and back flat surfaces; a plurality of mounting rails having a length greater than ½ a width of the panel and greater than the width of the panel, the mounting rails attached to the flat surface of the wall, each mounting rail having at least one elongate protrusion; and a plurality of panel clips attached to the back surface of each of the panels, the clips each having opposed elongate hooks that are attached to the elongate protrusions of the mounting rails and any one of the panels being removable from the flat surface of the wall with a pulling force.

In attaching the panel to the wall, it is contemplated that only opposed elongate hooks are secured to the elongate protrusion and the panels can be removed with a force perpendicular from the flat surface of the wall applied to the panel to be removed so that any one of the panels can be removed without removal of an adjacent panel. The perpendicular force may be plus or minus 25 degrees from 90 degrees with respect to the flat surface of the wall.

The elongate protrusion may extends outward perpendicular to the flat surface and have a mirror image about a horizontal perpendicular plane so that the panel clips can be removed from or attached to the mounting rails by pulling the panel perpendicularly away from the flat surface or pushing the panel perpendicularly toward the flat surface.

In another aspect, a structure having a wall defining a flat surface with a face mounting system mounted on the flat surface of the wall is disclosed. The face mounting system may include a plurality of panels. The structure may comprise the wall; the plurality of panels, each panel being between 6"×6" and 20"×20" and having a thickness between 5/16" and 1", each panel defining front and back flat surfaces; a plurality of panel clips greater than ½ a width of the panel and greater than the width of the panel, the panel clips attached to the flat surface of the wall, each panel clip having opposed elongate hooks; and a plurality of mounting rails attached to the back surface of each of the panels, the mounting rails each having at least one elongate protrusion that are attached to the opposed elongate hooks of the panel clips and any one of the panels being removable from the flat surface of the wall with a pulling force.

In attaching the panel to the wall, it is contemplated that only opposed elongate hooks are secured to the elongate protrusion and the panels can be removed with a force perpendicular from the flat surface applied to the panel to be removed so that any one of the panels can be removed without removal of an adjacent panel. The perpendicular force may be plus or minus 25 degrees from 90 degrees with respect to the flat surface of the wall.

The elongate protrusion may extend toward and perpendicular to the flat surface and have a mirror image about a perpendicular plane so that the panel clips can be removed from or attached to the mounting rails by pulling the panel perpendicularly away from the flat surface or pushing the panel perpendicularly toward the flat surface.

In another aspect, a method of installing a face mounting system to a wall is disclosed. The method may comprise the steps of attaching a first elongate rails to a flat surface of the wall, the first elongate rails having a first protrusion which is straight; aligning a second elongate rail having a second protrusion which is straight parallel to the first protrusion; attaching the second elongate rails to the flat surface of the wall while holding the alignment achieved during the aligning the second elongate rail step; aligning and attaching additional elongate rails to the flat surface of the wall so that protrusions of the additional elongate rails are parallel to the first and second protrusions of the first and second elongate rails; and attaching upper and lower clips to each panel of a plurality of panels, a distance between the upper and lower clips being equal to a distance between the first protrusion of the first elongate rail and the second protrusion of the second elongate rail so that the upper and lower clips are attachable to adjacent elongate protrusions.

In the method, the clips may have opposed hooks that latch onto the protrusion.

The method may further comprise the step of attaching a suction cup with a handle to a front surface of the panel to hold the panel while pushing the panel toward the wall for attaching the upper and lower clips attached to the panel to corresponding rails attached to the flat surface of the wall.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 7:
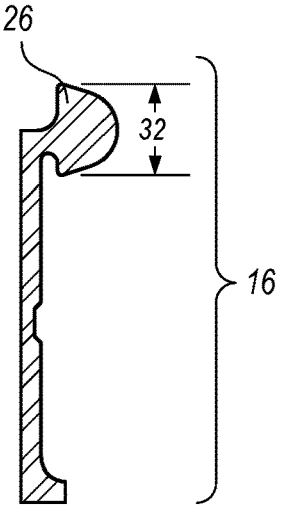
FIG. 7 illustrates a horizontal rail of a first embodiment.
Figure 8:
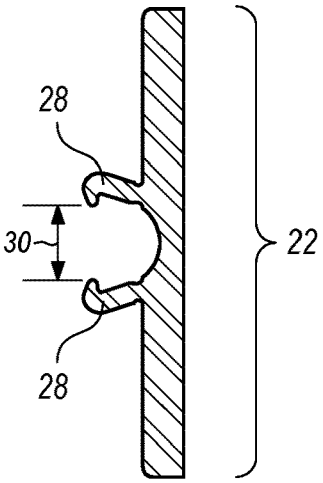
FIG. 8 illustrates the clip.

Referring now to the drawings, a face mounting system 10 is shown. The face mounting system 10 is mounted to a wall 12 to provide for aesthetic improvements over the bare wall 12 and also to protect a wall surface 14. The face mounting system may include a plurality of horizontal rails 16, 18, 20 (see FIGS. 7, 10, 13) attached to the wall 12. The face mounting system 10 may also include a plurality of clips 22 (see FIG. 8) attached to a plurality of panels 24 so that when the clips 22 are attached to the horizontal rails 16, 18, 20, the panels 24 are mounted to the wall 12. The horizontal rails 16, 18, 20 may have a protrusion 26 that perpendicularly extends away from the wall surface 14 of the wall 12 when the horizontal rails 16, 18, 20 are attached to the wall surface 14. The clips 22 may have opposed hooks 28 that can engage over the protrusions 26 of the horizontal rails 16, 18, 20. The opposed hooks 28 have an inner gap 30 (see FIG. 8) which is slightly smaller than an outer width 32 (see FIG. 7) of the protrusion 26. The hooks 28 are formed so that they can be spread apart as the protrusion 26 is being pushed into a cavity 34 defined by the hooks 28. In doing so, the panels 24 are being mounted to the wall 12 one at a time and in any order. Additionally, the hooks 28 can be spread apart to remove the panels 24 from the wall 12. The panels 24 may be removed one at a time and in any order.

Figure 1:
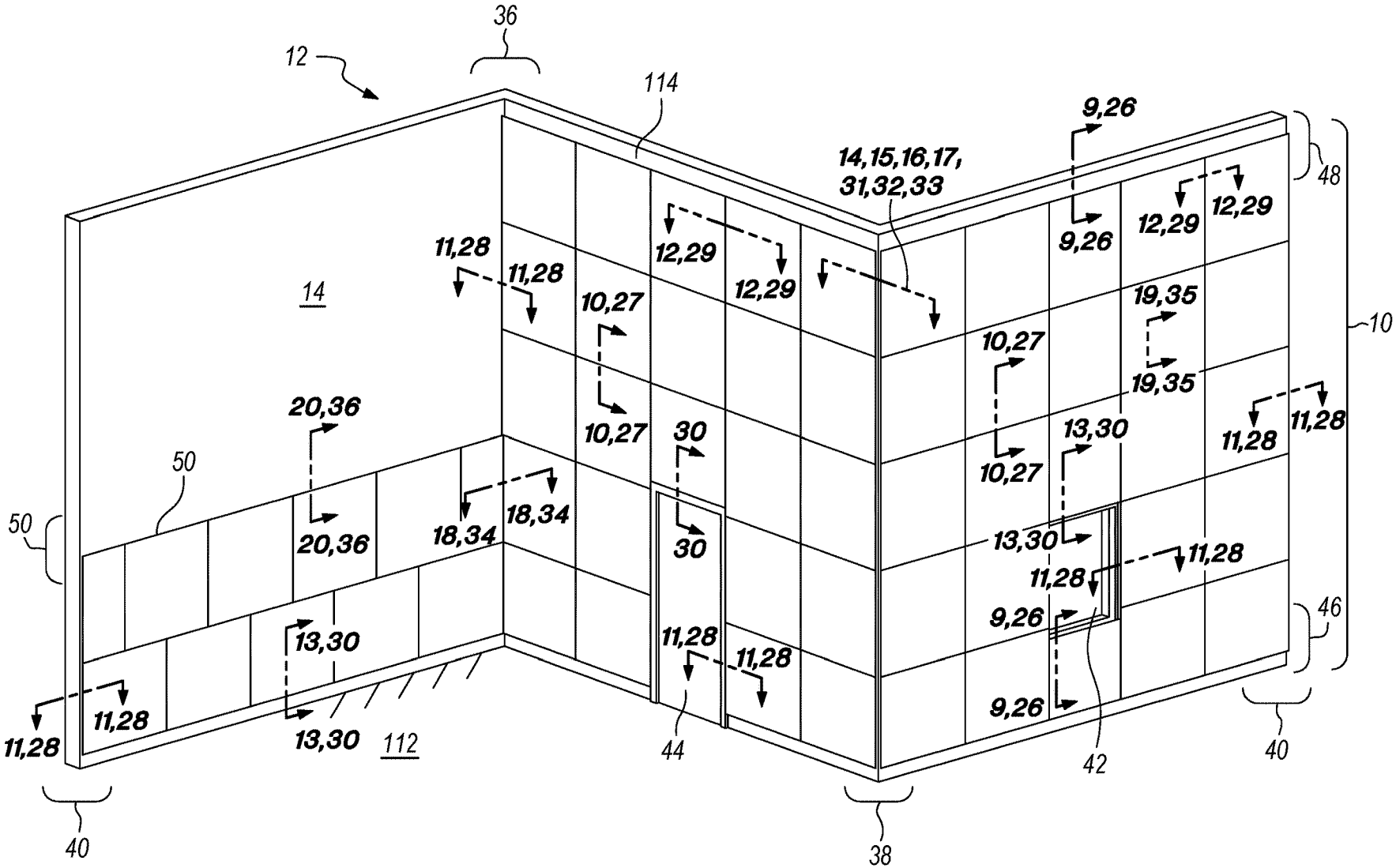
FIG. 1 illustrates a perspective view of a face mounting system of a plurality of wall panels mounted to a wall.
Figure 21:
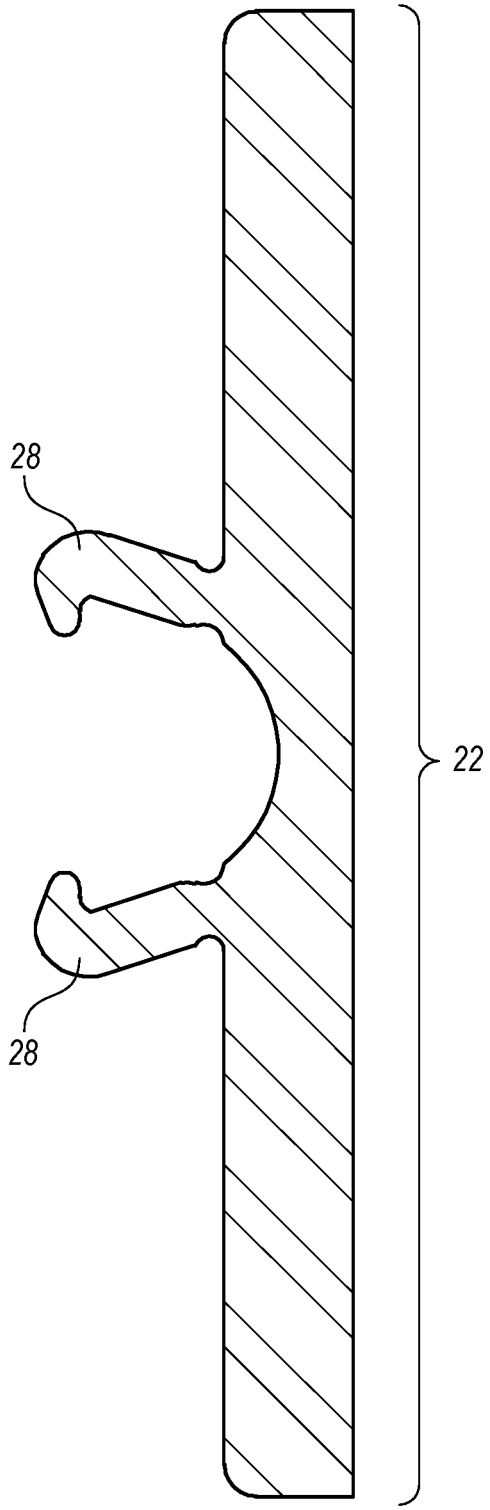
FIG. 21 illustrates the clip.
Figure 22:
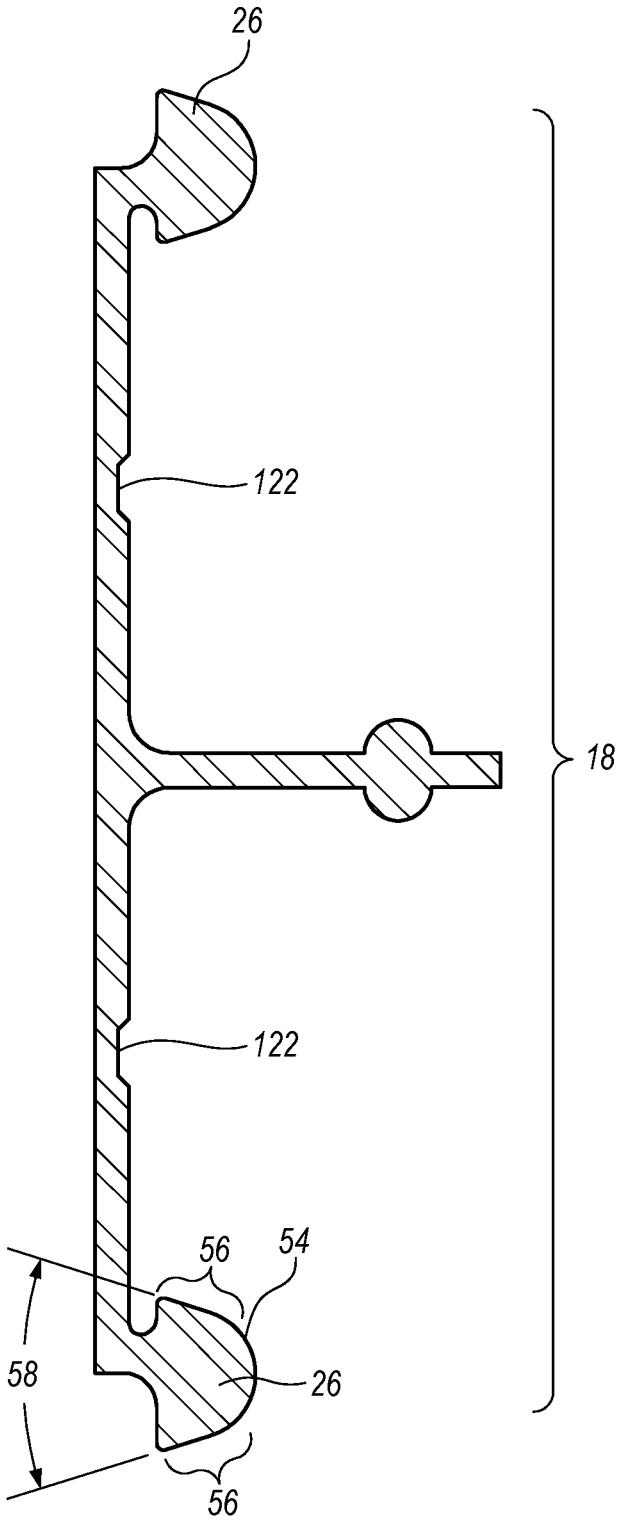
FIG. 22 illustrates a horizontal rail.
Figure 23:
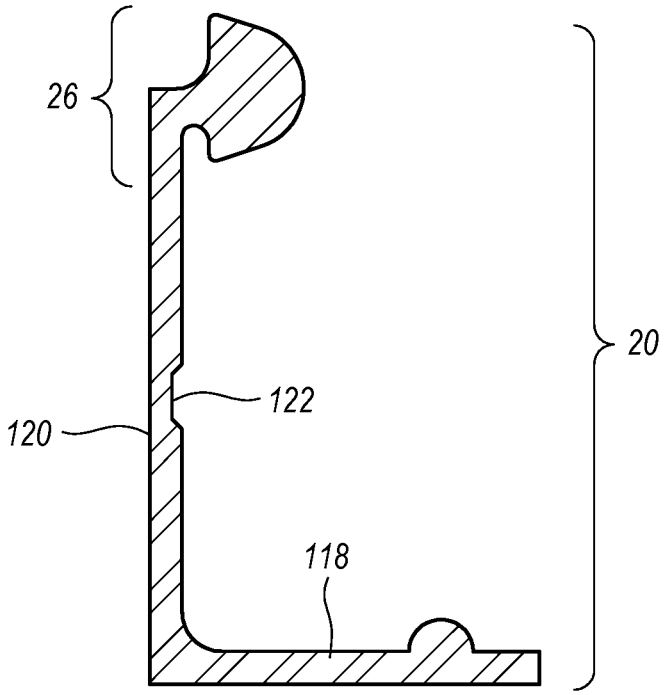
FIG. 23 illustrates top and bottom rails.
Figure 24:
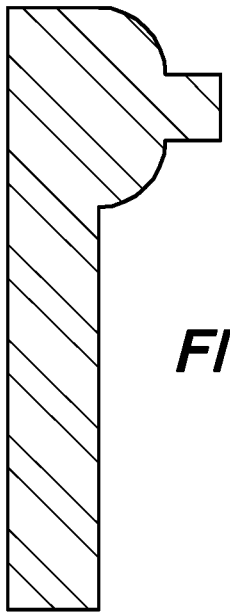
FIG. 24 illustrates a vertical joint detail.
Figure 25:
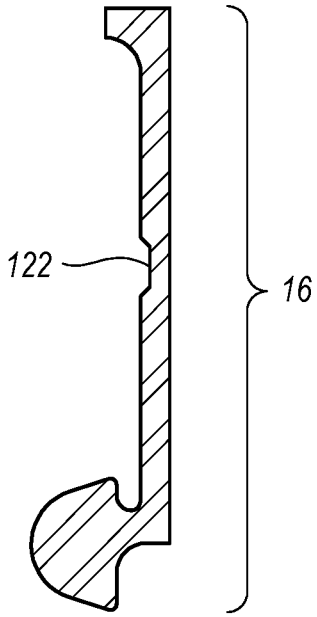
FIG. 25 illustrates the mid wall clip.
Figure 26:
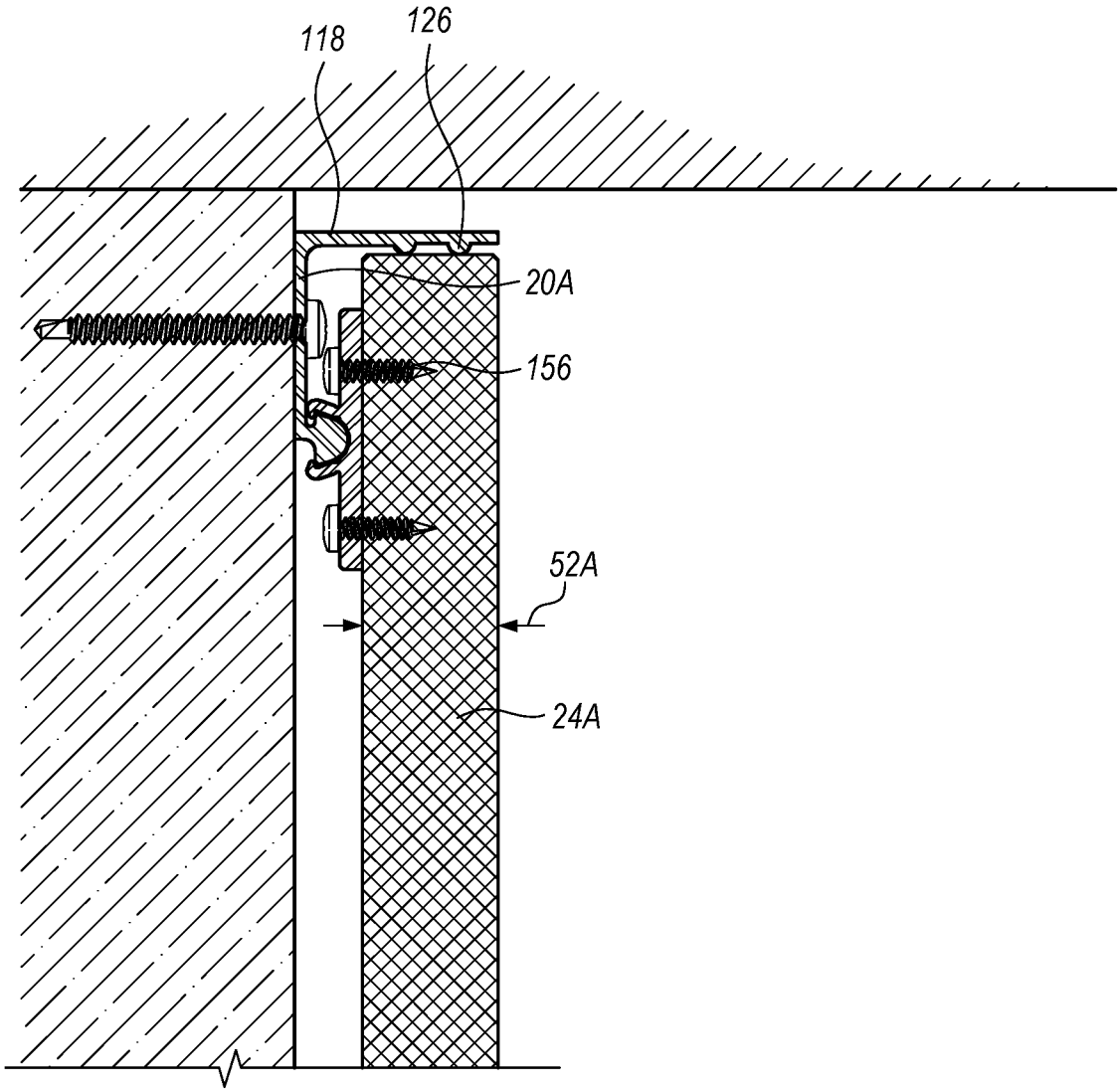
FIG. 26 illustrates attachment of a thicker panel compared to the panel shown in FIG. 9 adjacent to a ceiling.
Figure 27:
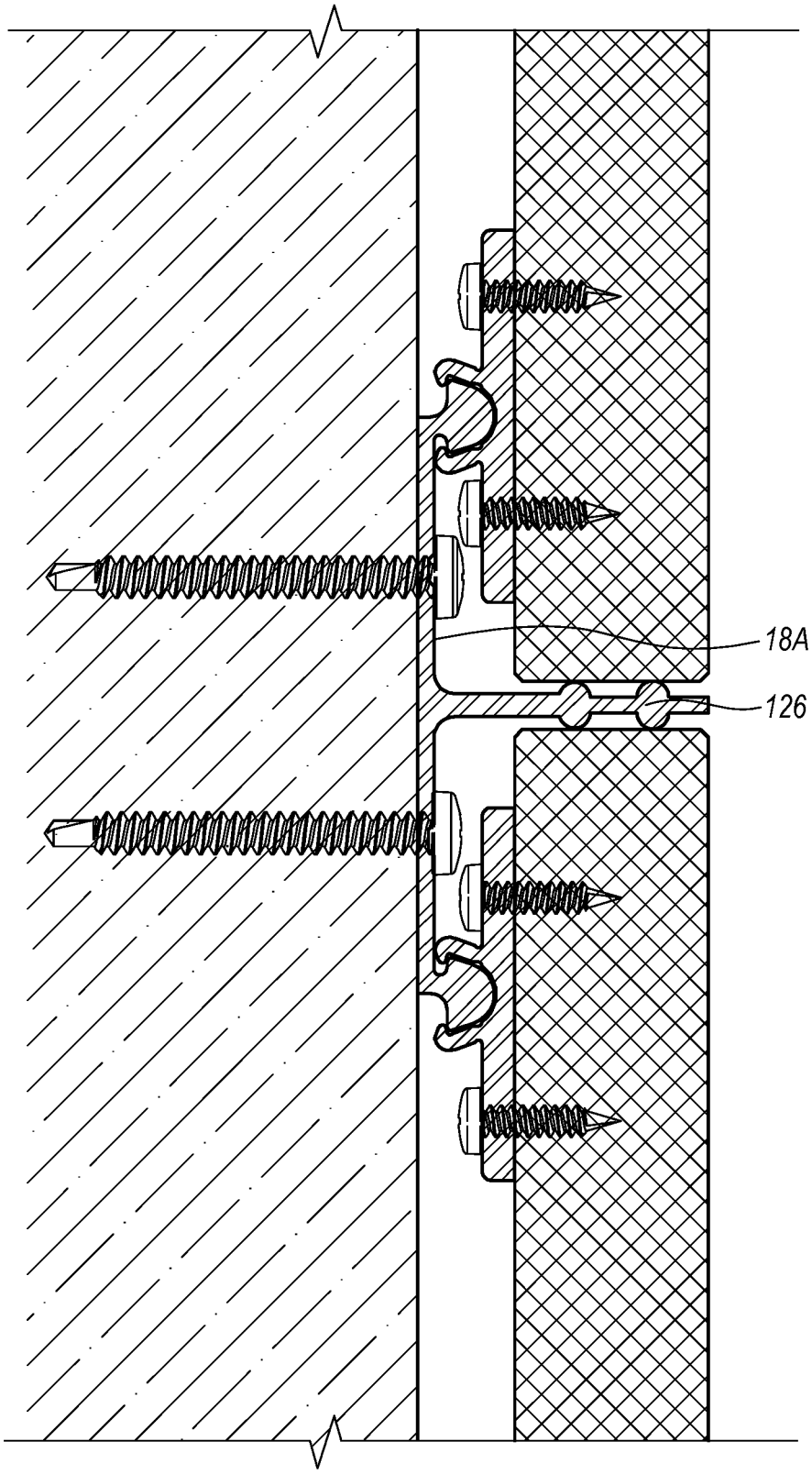
FIG. 27 illustrates a horizontal joint for attaching the thicker upper and lower panels to the wall.
Figure 28:
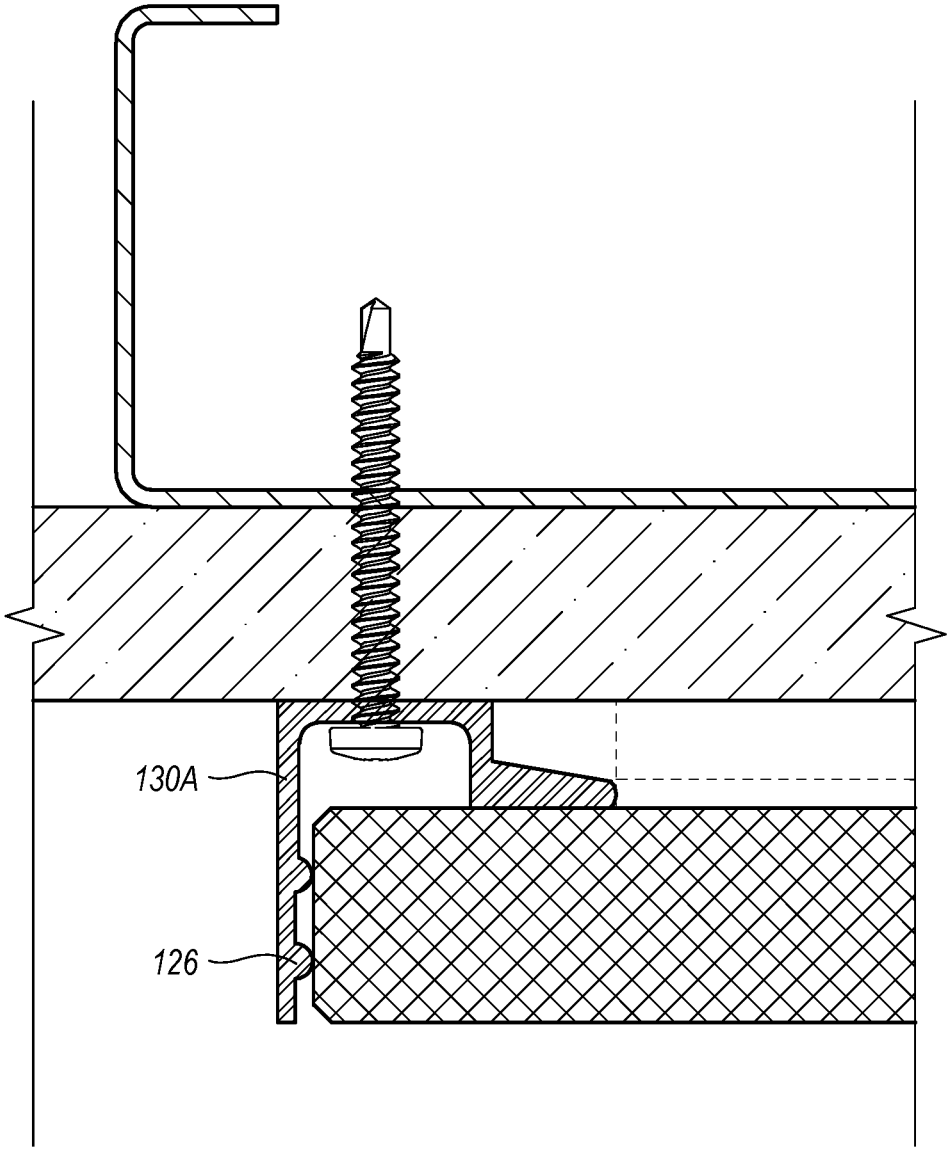
FIG. 28 illustrates a vertical edge detail for the thicker panel.
Figure 29:
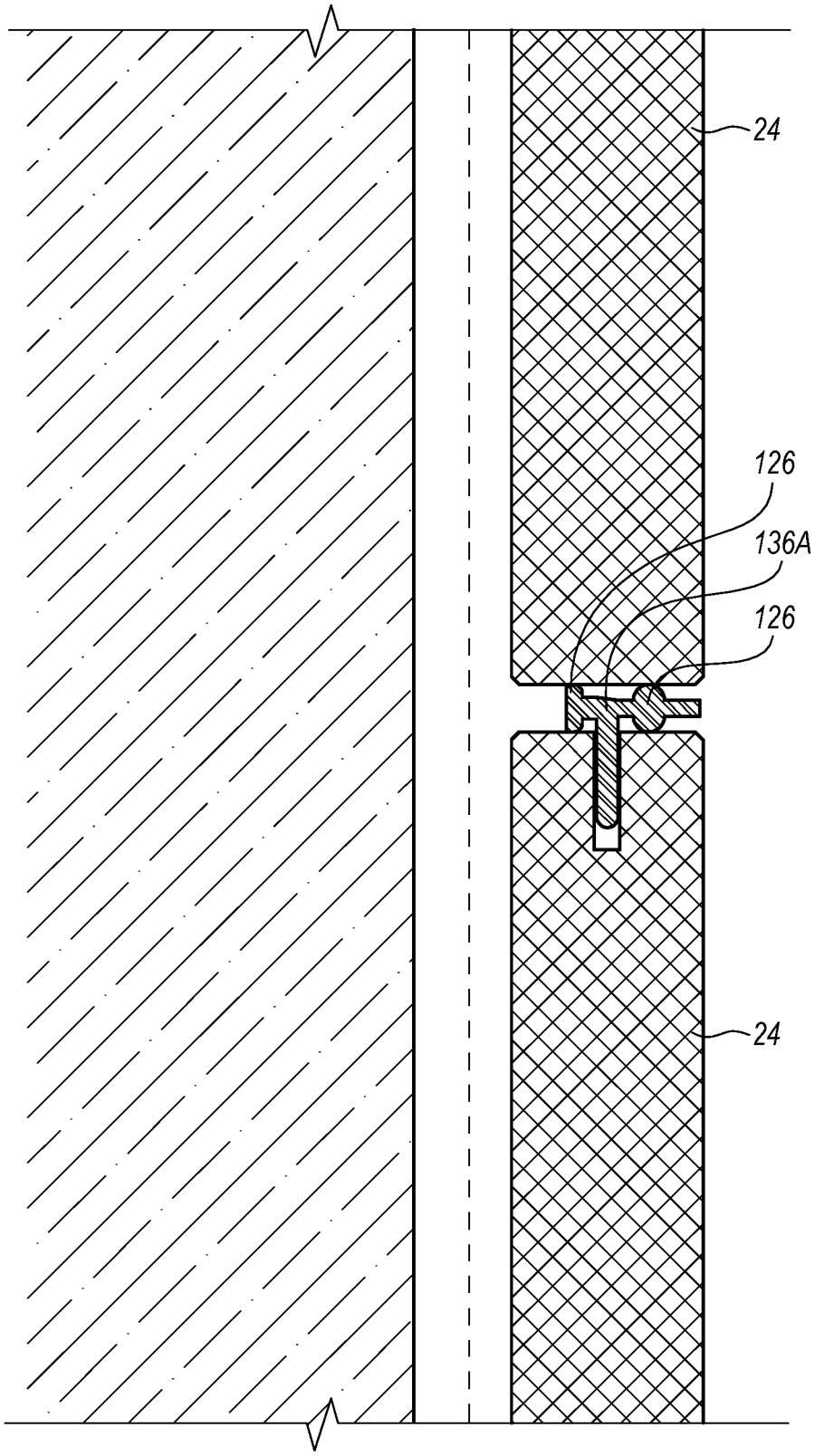
FIG. 29 illustrates a vertical joint detail for the thicker panel.
Figure 30:
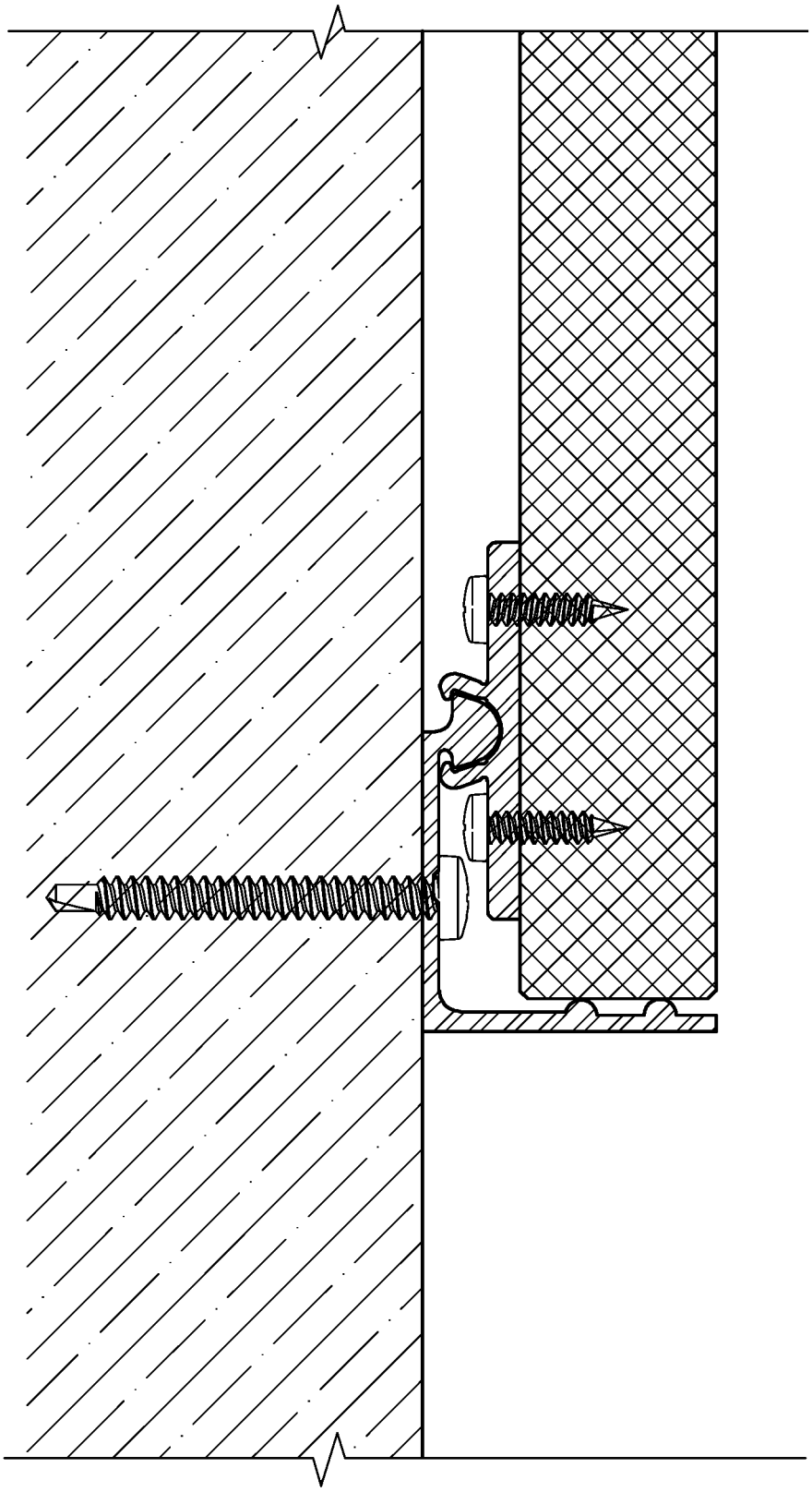
FIG. 30 illustrates a bottom rail for mounting the thicker panel to the wall.
Figure 31:
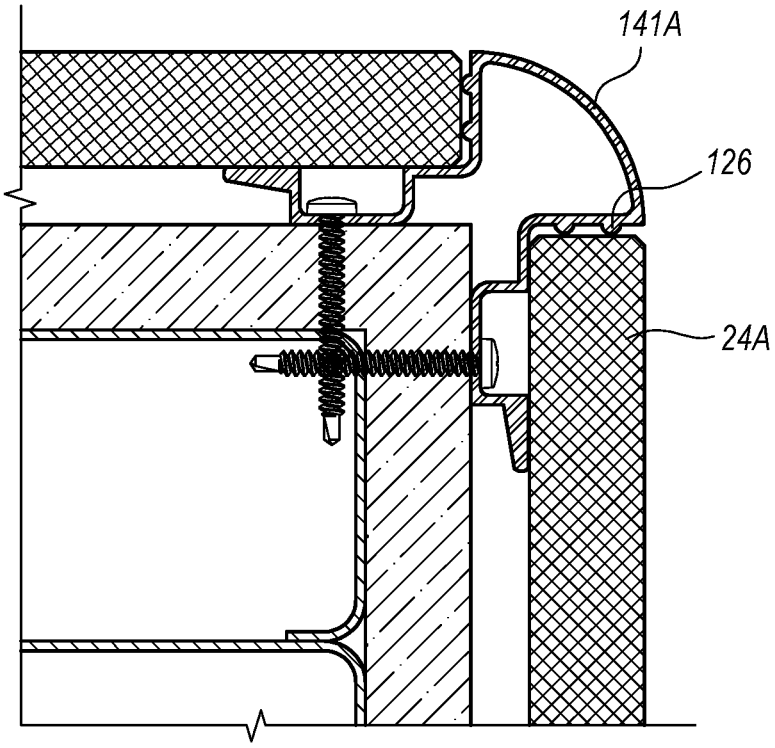
FIG. 31 illustrates the first embodiment of the outside corner for the thicker panel.
Figure 32:
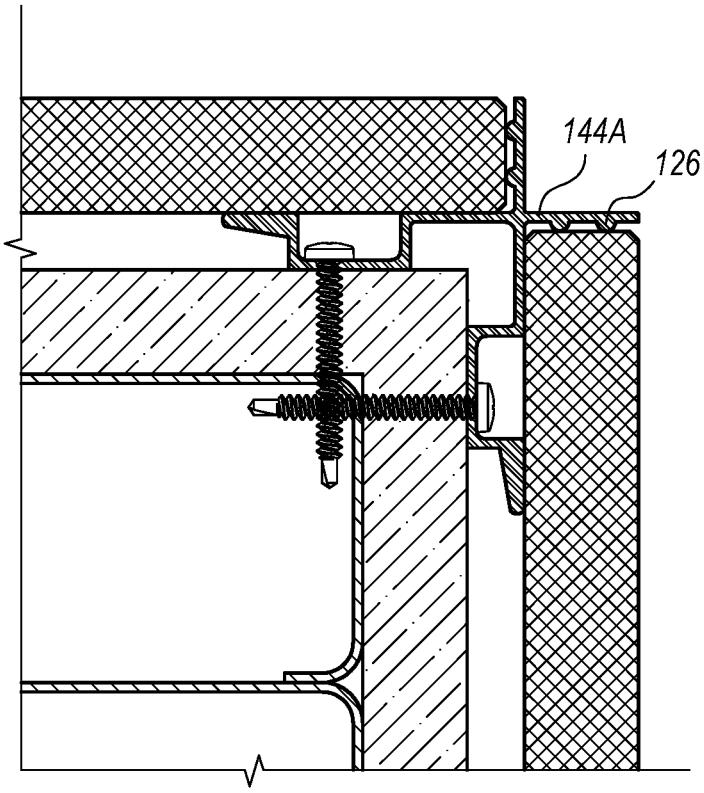
FIG. 32 illustrates the third embodiment of the outside corner for the thicker panel.
Figure 33:
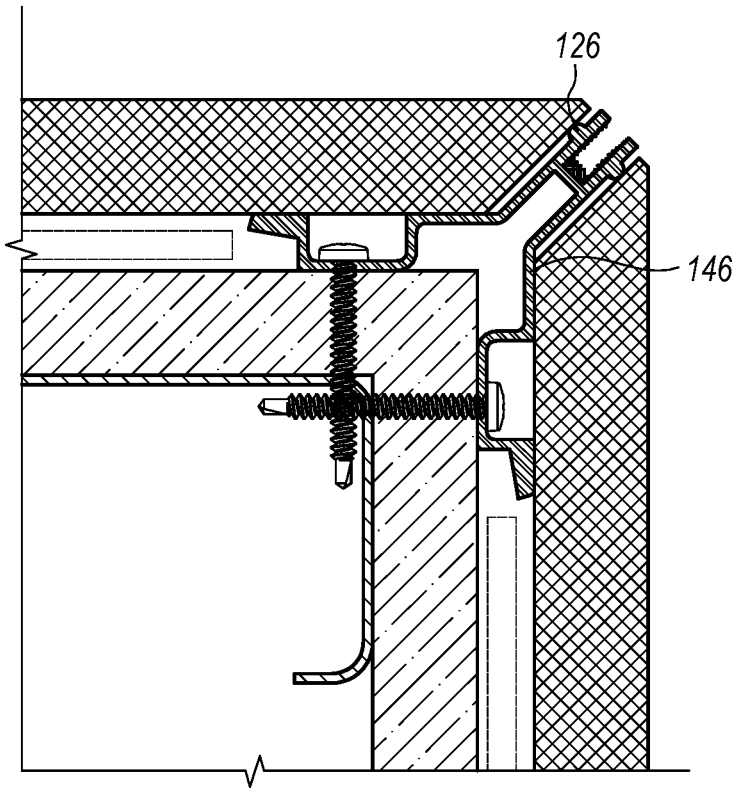
FIG. 33 illustrates the fourth embodiment of the outside corner for the thicker panel.
Figure 34:
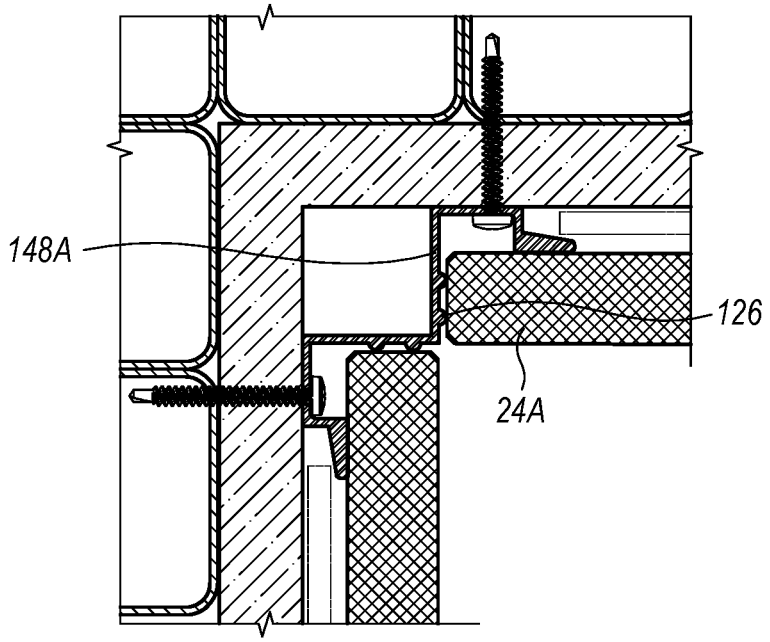
FIG. 34 illustrates an inside corner for the thicker panel.
Figure 35:
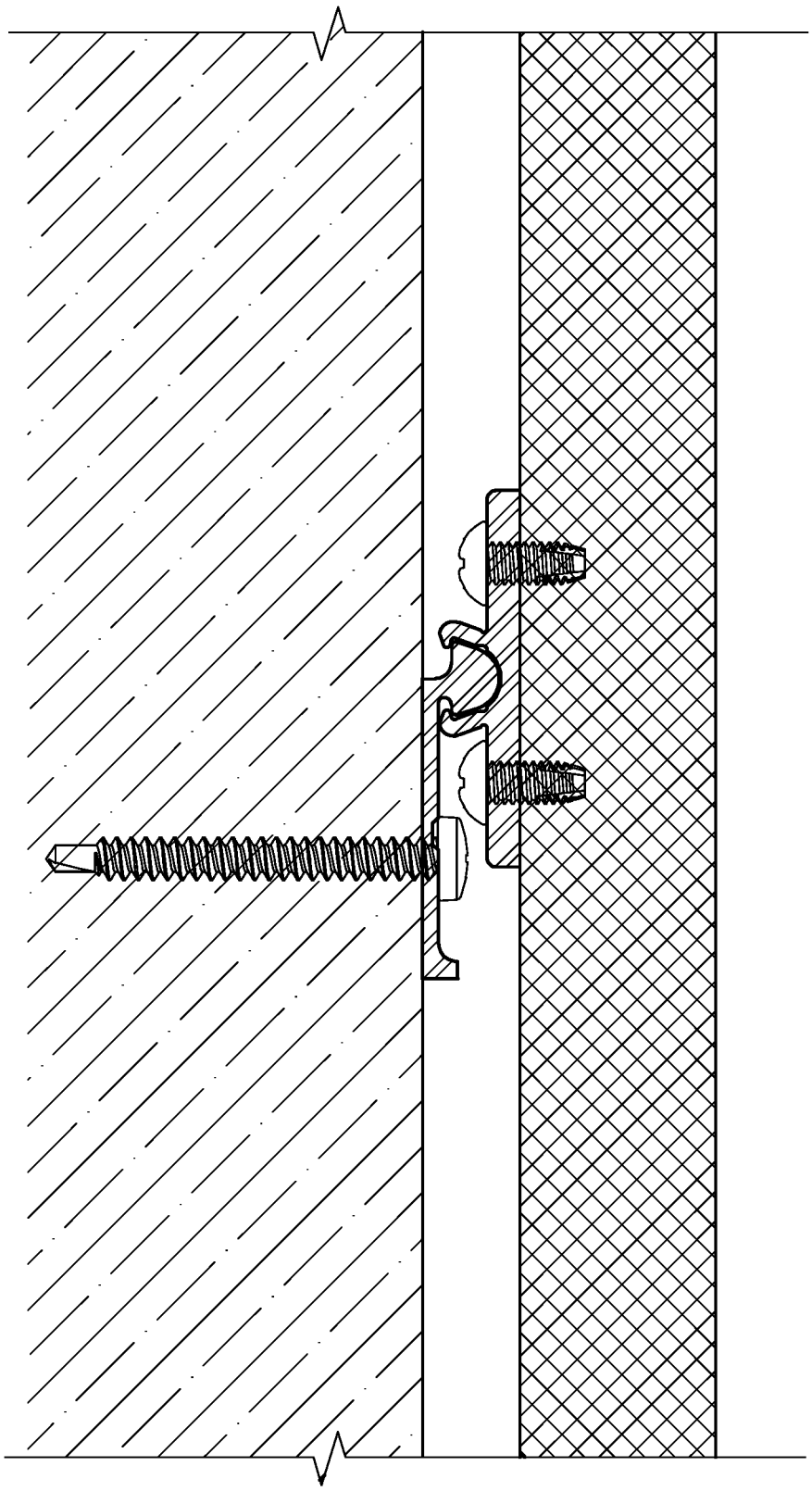
FIG. 35 illustrates a mid wall clip for the thicker panel.
Figure 36:
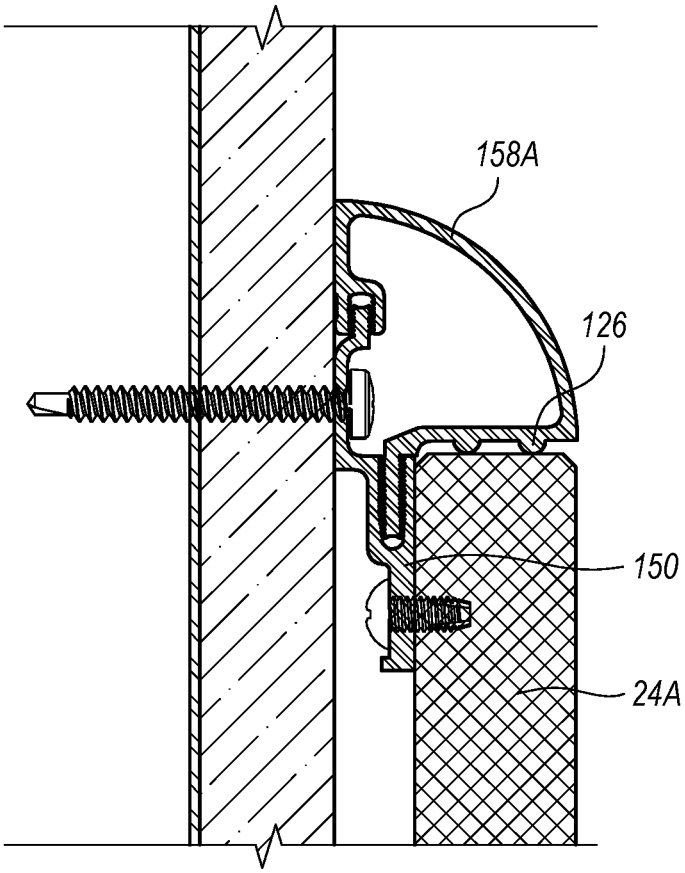
FIG. 36 illustrates a wainscot edge for the thicker panel.
Figure 37:
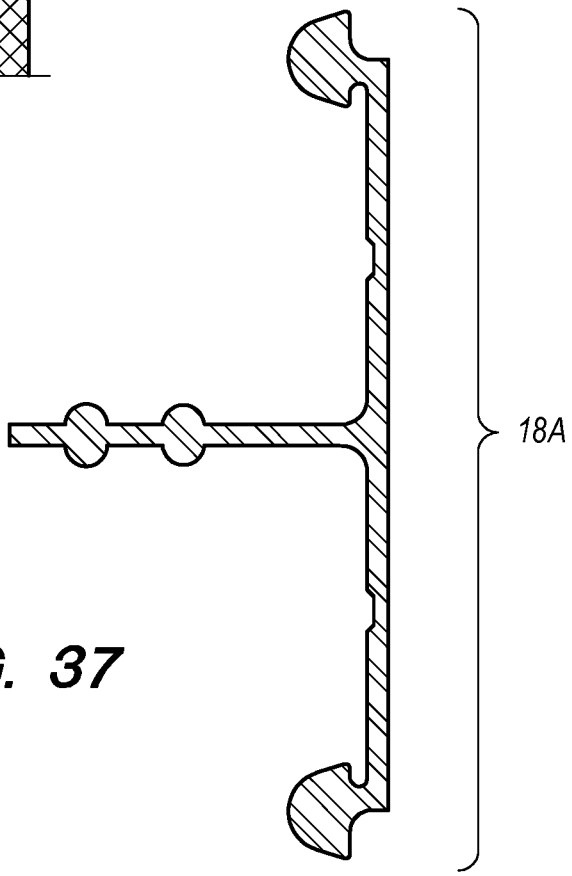
FIG. 37 illustrates a second embodiment of the rail for the thicker panel.
Figure 38:
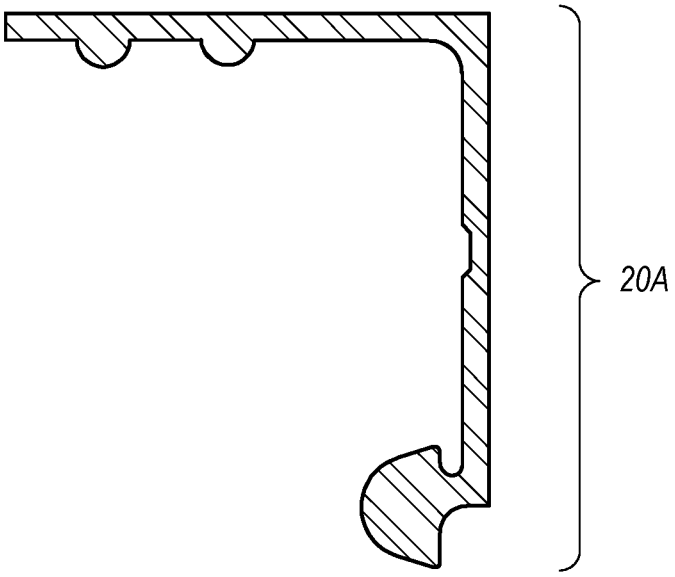
FIG. 38 illustrates a second embodiment of the top and bottom rails for the thicker panel.

Referring now to FIG. 1, the face mounting system 10 is illustratively shown being mounted to the wall 12 having various features including an inside corner 36, an outside corner 38, a vertical free edge 40, a window 42, a door 44, a bottom edge 46, a top edge 48, and a wainscot edge 50. FIGS. 9-20 illustrate how a ⅜ inch thick panel 24 may be mounted to the wall 12, whereas, FIGS. 26-36 illustrate how a ¾ inch thick 52 panel 24*a* may be mounted to the wall 12. FIGS. 2-8 illustrate how the clips 22 and horizontal rails 16, 18, 20 may be mounted to the wall and also how they 16, 18, 20 and 22 are removably attachable to each other. Although only rail 16 is shown in FIGS. 2-8, the other rails 18, 20 operate in functionally the same way. FIGS. 21-23 illustrate the clips 22 and rail 18, 20, and more particularly, the hooks 28 and the protrusion 26. FIGS. 37 and 38 illustrate variants of the rails 18*a*, 20*a* when mounting a thicker panel 24.

Figure 2:
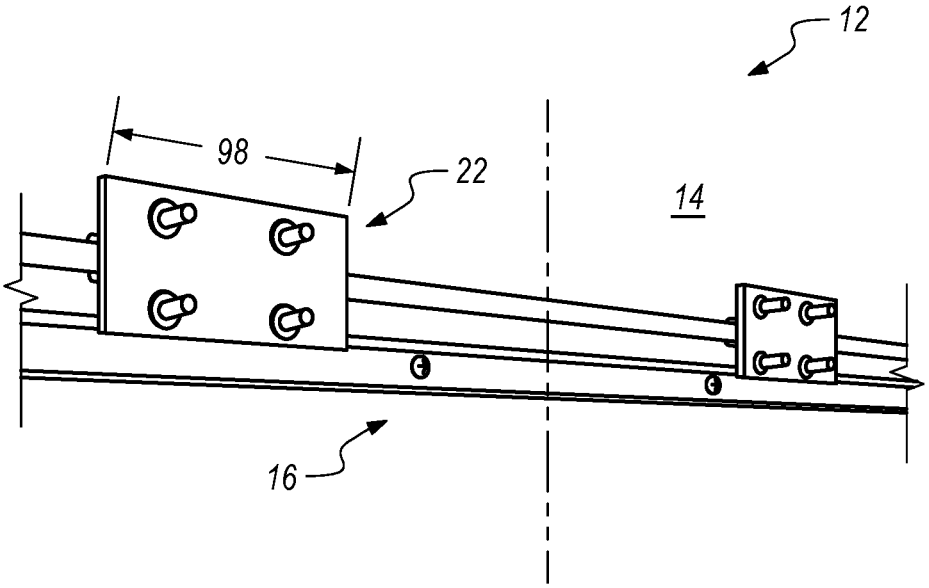
FIG. 2 illustrates a perspective view of a mid panel horizontal rail used to stabilize a middle area of a panel to the wall.
Figure 3:
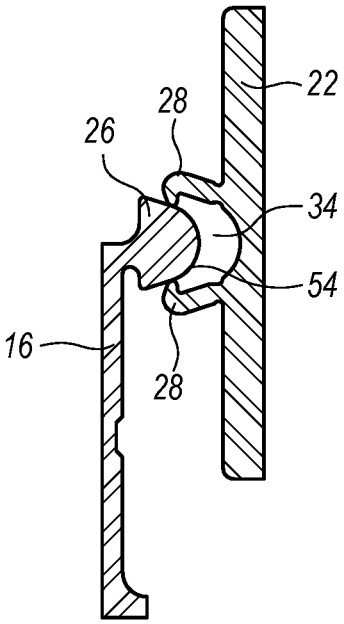
FIG. 3 illustrates a first state in which a protrusion of a rail is inserted between hooks of a clip in order to engage the rail to the clip and the panel to the wall.
Figure 19:
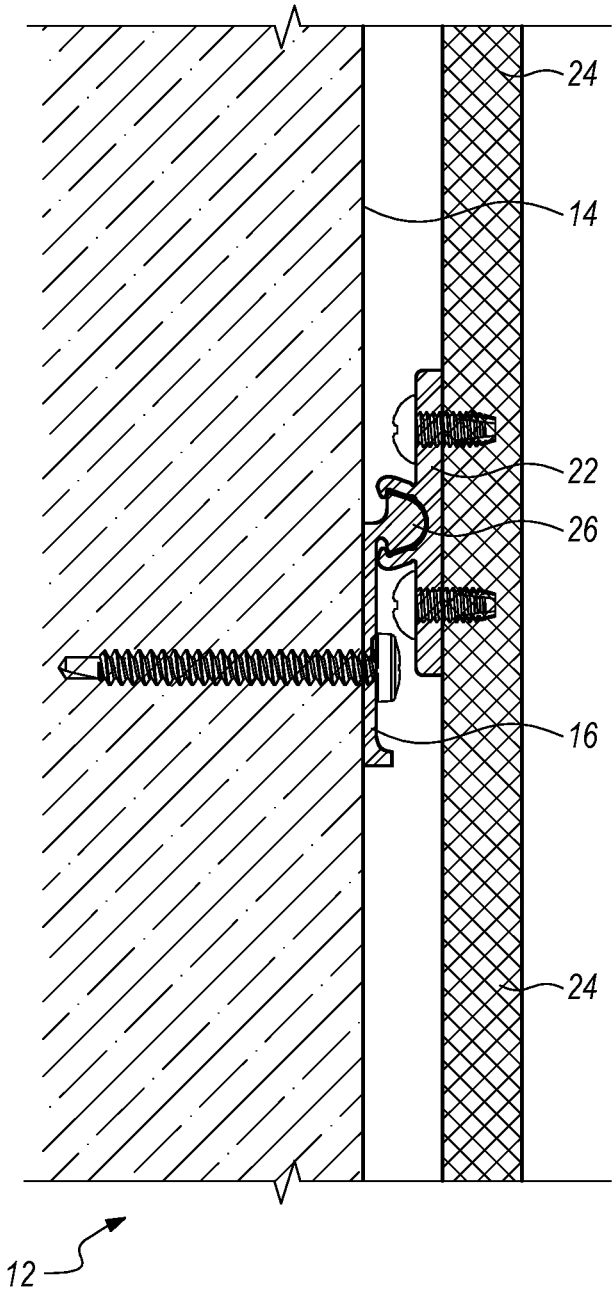
FIG. 19 illustrates a mid wall clip.

Referring now to FIG. 2, a mid panel horizontal rail 16 and clip 22 is shown. FIG. 19 also illustrates the mid panel horizontal rail 16 and clip 22 for mounting the panel 24 to the wall 12. FIGS. 3-6 illustrate the progression of the process of inserting the protrusion 26 of the horizontal rail 16 to the hooks 28 of the clip 22. The protrusion 26 may have a bulbous front side 54. The front side 54 although being shown as being bulbous may have other configurations including but not limited to two flat sides 56 shaped into an acute angle (e.g. triangularly shaped). The front side 54 of the protrusion 26 may have opposed flat portions 56 that form an angle 58 with each other between 25° and 80° but is preferably 70°.

Figure 22A:
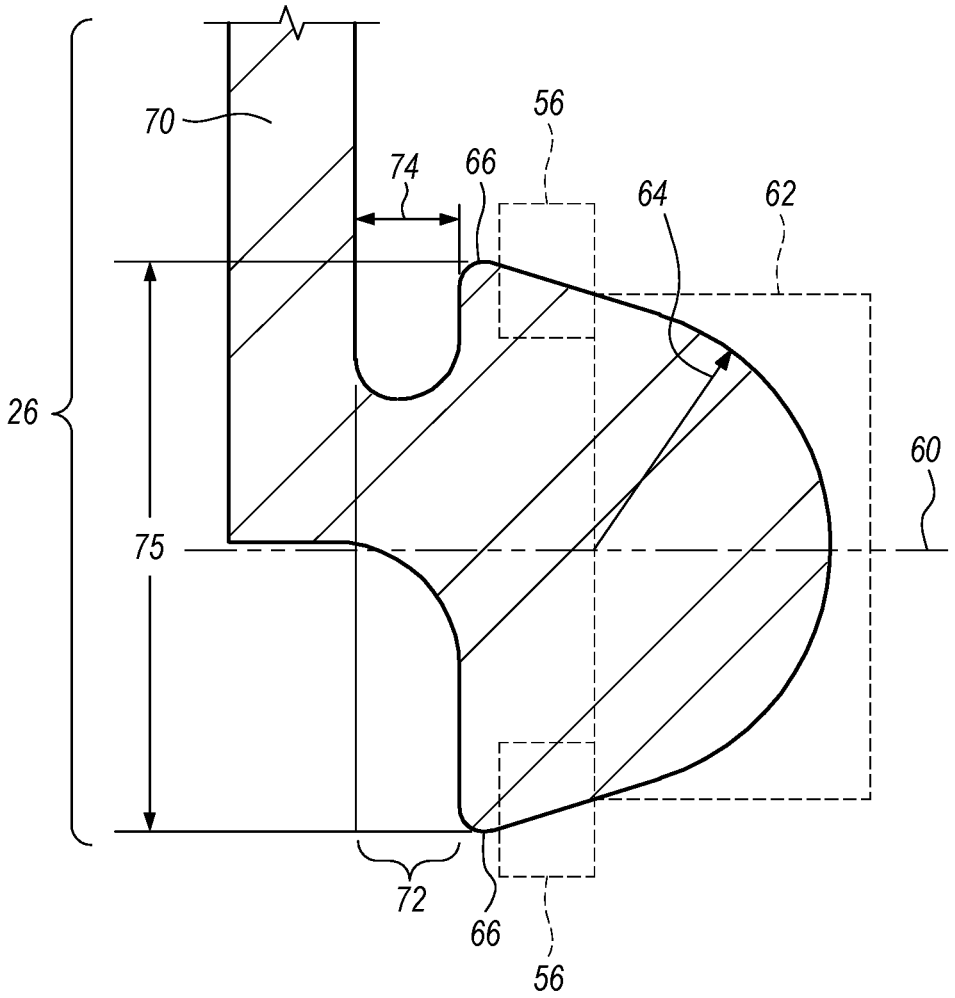
FIG. 22A is an enlarged view of the protrusion of the horizontal rail shown in FIG. 22.

Referring now to FIGS. 22 and 23, horizontal rails 18, 20 are shown. More particularly, as shown in FIG. 22A, an enlarged view of the protrusions 26 is illustrated. The protrusions 26 may be symmetrical about a horizontal plane 60. An apex portion 62 may have an exterior surface defined by a radius 64. The radius 64 may be 0.120 inches. The protrusion 26 may also have the opposed flat portions 56 that contact the hooks 28 and spread open the hooks 28 as shown by the progression shown in FIGS. 3-6. The opposed bottom edges 66 may have a radius 68. The radius 68 may be 0.013 inches. One side of the protrusion 60 may have a base 70 that is connected to the protrusion 26 with a neck portion 72. The neck portion 72 may have an inner radius and a gap 74. The gap 74 may be about 0.0255 inches.

The opposed bottom edges 66 may have the same radius or different radius. By way of example and not limitation, the bottom edge 66 on the side of the base 70 may have a radius of 0.013 inches whereas the opposed bottom edge 66 on the side opposite of the base 70 may have a radius of 0.012 inches. The protrusion 26 described in relation to FIG. 22A may be replicated on the horizontal rails 16, 18, 20. A width 75 of the protrusion may be 0.282 inches. The width 75 may be slightly greater than an internal gap 78 (see FIG. 21A) so that the hooks 28 can latch onto the protrusion 26.

Figure 21A:
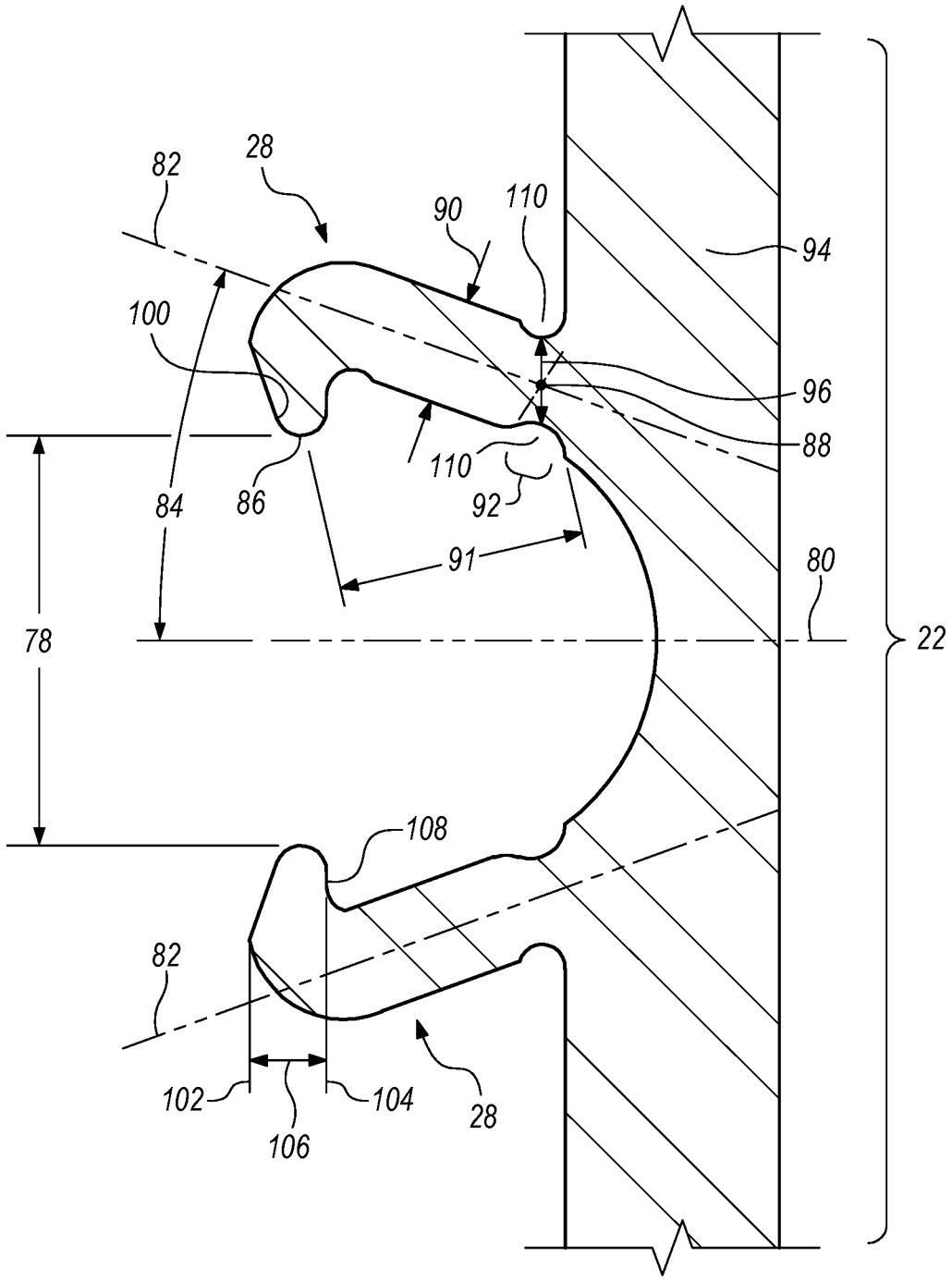
FIG. 21A illustrates an enlarged view of hooks of the clip shown in FIG. 21.

Referring now to FIG. 21A, the hooks 28 of the clips 22 are shown. The hooks 28 may also be symmetrical about horizontal plane 80. In this regard, the hooks 28 may be mirror configurations to each other. The hooks 28 may have a centerline 82. The centerline 82 may be angularly offset from the horizontal plane 80 by angle 84. The angle 84 may be 35.5°. The hooks 28 may also define a length from an innermost point 86 to a central rotating axis 88 of the hook 28. The length 91 may be about 0.076 inches. A thickness 90 of the hooks 28 may be sufficient so that the hooks 28 are generally rigid or have less displacement compared to neck portion 92 that connects the hook 28 to the base 94. The neck portion 92 may have a thickness 96 of between 0.010 inch and 0.002 inch and be preferably 0.005 inches. As the length 91 increases, the thickness 96 may increase due to the increased leverage of the increased distance 91. In turn, the length of the clip 22 may be decreased. The length 98 may be about 2⅜" for the existing configuration which provides sufficient amount of material at the neck portion 92 so that the hooks 98 are not torn off when the hooks 28 are spread open to latch on to the protrusion 26.

Figure 4:
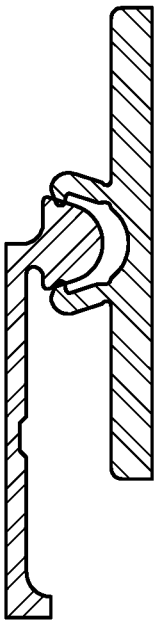
FIG. 4 illustrates a second state in which the protrusion of the rail is further inserted between the hooks of the clip in order to engage the clip to the rail and the panel to the wall.
Figure 5:
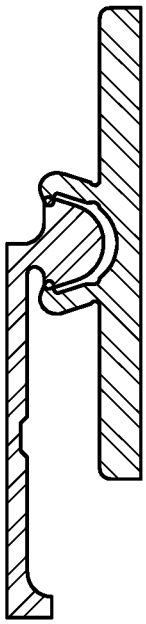
FIG. 5 illustrates a third state in which the protrusion of the rail is even further inserted into the hooks of the clip in order to engage the clip to the rail and the panel to the wall.
Figure 6:
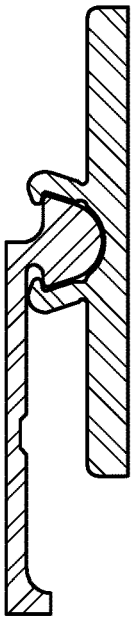
FIG. 6 illustrates a final state in which the protrusion of the rail is fully inserted into the hooks of the clip in order to engage the clip to the rail and the panel to the wall.

The hooks 28 may have a radiused surface 100 which defines the innermost point 86. When the protrusion 26 is being inserted into the cavity 34 defined by the hooks 28, the protrusion 26 may contact the radiused surface 100 as the protrusion 26 is being inserted into the cavity 34. When the protrusion 26 initially contacts the hooks 28, the radius portion 100 contacts the apex portion 62 and more preferably the opposed flat portion of 56 of the protrusion 26. Because of the angled surfaces of the opposed flat portions 56, the hooks 28 are spread open as shown in FIGS. 4 and 5. At some point during insertion, the protrusion will slide on and contact the innermost point 86 for at least a portion of the insertion process or throughout the entire insertion process. When the protrusion 26 is fully inserted into the cavity 34, the radiused surface 100 is at least partially behind the protrusion 26 in order to hold the protrusion 26 inside of the cavity 34. The exterior configuration of the protrusion 26 may have a slightly smaller footprint compared to an interior surface of the cavity 34 so that the protrusion 26 can slightly wiggle inside of the cavity 34 by about one or two thousandth of an inch. The protrusion 26 may be held snugly within the cavity 34 defined by the hooks by wedging one of the hooks 28 into the gap 74. That hook 28 may fill up the gap 74 to remove any play or wiggle room between the protrusion 26 and the cavity 34. More particularly, the hook 28 may have a hook distance 106 defined by two parallel lines 102, 104. The line 102 being aligned to a distal most end of the hook 28 that is wedged into the gap 74. The line 104 is defined by an interior flat surface 108 of the hook 28. When the hook 28 is wedged into the gap 74, the distal most end of the hook 28 that intersects line 102 may contact the base 70 of the rail 16, 18, 20 and the radiused surface 100 contacts the opposed bottom edges 66 of the protrusion 26. The hooks 28 are allowed or can spread apart because of the relief provided by opposed grooves 110 on each of the hooks 28 to help neck down the neck portion 92 of the hooks 28. Moreover, the hooks 28 can be spread apart because of the material from which the hooks 28 are fabricated. As discussed below, the clips 22 may be fabricated from a plastic material such as acrylonitrile butadiene styrene (ABS) which is strong and the hooks 28 will not break off due to the bending stresses imposed on the clips 22/hooks 28. The hooks 28 being a part of the clips 22 means that the hooks may be fabricated from a plastic material. The plastic material also has a memory in that once the hooks 28 are spread apart, the hooks 28 go back to its original position. Additionally, the plastic material should be selected so as to allow the repeated mounting of the clips 22 to the rails and removal without significantly weakening the hooks 28 ability to secure the panel to the wall. For example, the plastic material should be selected so as to allow the mounting and removal of the clips 22 to the rails between 20 cycles to 1000 cycles and preferably around 100 cycles.

Referring now back to FIG. 1, the plurality of panels may be mounted to the wall 12. The panels may be arranged in aligned columns and rows. Alternatively, the panels 24 may be offset either horizontally or vertically. Moreover, the panels 24 are shown as being rectangular or square. However, it is also contemplated panels 24 may be uniquely shaped and the plurality of panels 24 need not cover the entire wall 12. Moreover, it is also contemplated that a single panel 24 may be connected or mounted to the wall 12 at any position by attaching the rail to the wall 12 and the clip 22 to the panel or vice versa. The horizontal rails 16, 18, 20 and the clip 22 may be utilized to mount other objects to the wall 12 including but not limited to objects, paintings, pictures, frames, artwork.

FIG. 1 illustrates panels positioned on the wall 12 adjacent to various features including but not limited to a floor 112, the inside corner 36, the outside corner 38, a ceiling 114, the wainscot edge 50, an open edge 40, the door 44, and the window 42. Various cross-sections are taken and shown in FIGS. 9-20 to illustrate how the rails 16, 18, 20 and the clips 22 as well as other components are used to mount the panels 24 to the wall 12.

The panels 24 as shown in FIG. 1 are square or rectangularly shape. For panels 24 that are about 8"×8" or greater, there may be four clips 22 attached to a back surface 116 of the panel 24. Each of the four clips 22 may be positioned at or near the four corners of the panel 24. The two clips 22 that are positioned at the upper corners of the panel 24 may be horizontally aligned to each other so that their 22 protrusions 26 are horizontally aligned to each other. Also, the two clips that are positioned at the lower corners of the panel 24 may be horizontally aligned to each other as well in that the cavities 34 are horizontally aligned. The wall surface 14 may have a plurality of rails 16, 18, 20 that are aligned horizontally and mounted to the wall surface 14. The two clips that are positioned at the upper corners of the panel 24 may be mounted to the same rail 16, 18 or 20. Also, the two clips that are positioned at the lower corners of the panel 24 may be mounted to a different rail than the rail that is connected to the clips positioned at the upper corners of the panel 24 but the same rail is connected to the two clips that are positioned at the lower corners of the panel 24. Depending on where the panel is located on the wall 12 with respect to the floor 112, ceiling 114, or other feature such as the door 44 or the window 42, the two clips at the upper corners of the panel 24 may be attached to one of the rails 16, 18, 20 and the two clips 22 at the lower corners of the panel 24 are attached to another one of the rails 16, 18, 20.

Figure 9:
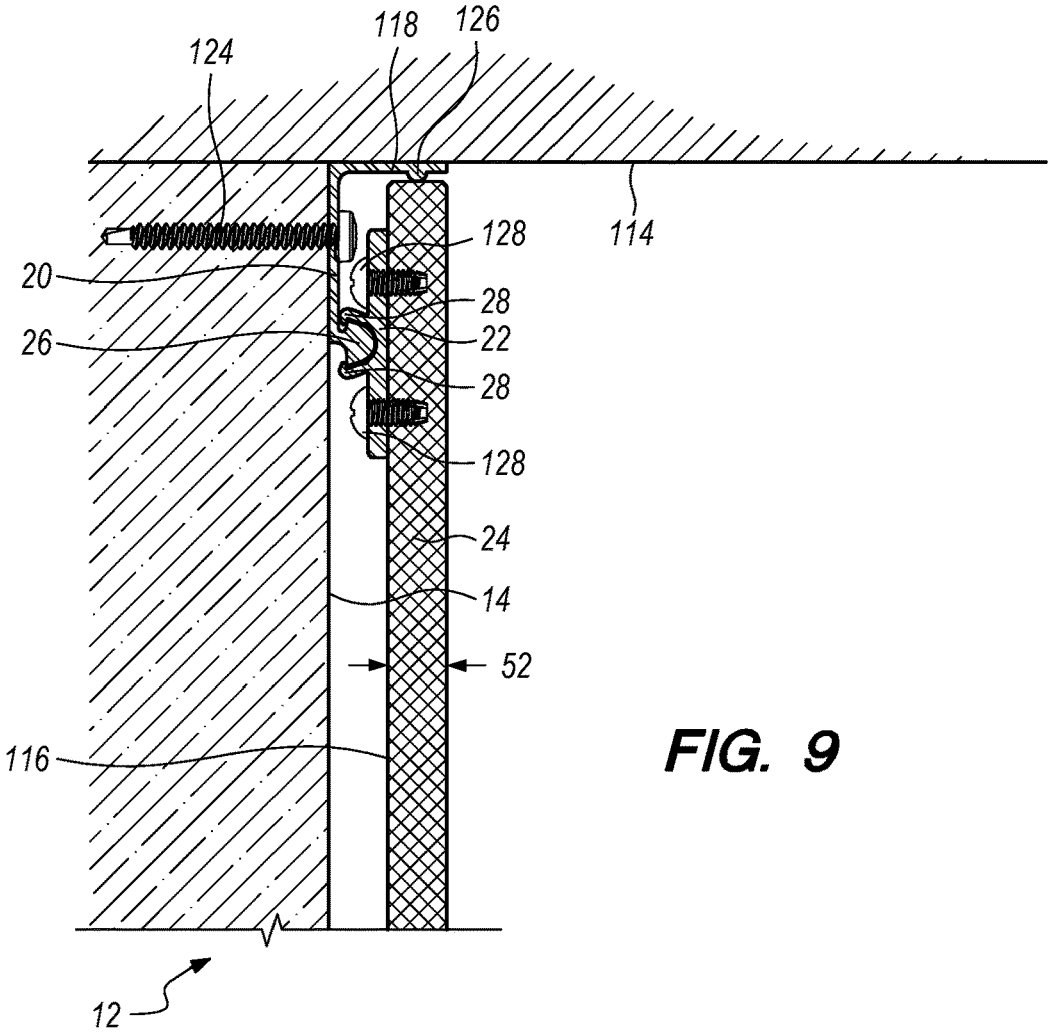
FIG. 9 illustrates attachment of the panel adjacent to a ceiling.

Referring now to FIG. 9, the panel 24 is attached to the wall 12 right below the ceiling 114. The rail 20 shown in FIG. 23 is mounted to the wall 12. In particular, a flange 118 butts up against the ceiling 114. A back surface 120 of the base of the rail 20 contacts the wall surface 14. The base of the rail 20 may have an indentation 122 along its longitudinal length. The indentation 122 may be used to indicate to an installer where a screw 124 should be located with respect to the base of the rail 20. The other rails 16, 18 may also have the indentation 122 which also locates where the screw 124 should be located. Clips 22 may be extruded plastic. The plastic material may be ABS and provided in various lengths including but not limited to a length shorter than the width of the panel 24, between 2 to 6 inches and preferably 4 inches. The horizontal rails 16, 18, 20 may be extruded aluminum and provided in various lengths including but not limited to a length shorter than the width of the panel 24, 2 feet long, 4 feet long, 6 feet long, 8 feet long, 10 feet long, 12 feet long or longer or any increments of 1 foot. The clips 22 are preferably 2⅜" long. The flange 118 may also have a spacer 126 that contacts an edge of the panel 24. With the rail 20 secured to the wall 12 with the screw 124, the panel 24 may be secured to the wall 12 by inserting the protrusion 26 between the hooks 28 of the clip 22. The clip 22 may be secured to the panel 24 with screws 128. As discussed above, the panel 24 may have two clips 22 at the same horizontal elevation so that two clips 22 are secured to the rail 20.

Figure 10:
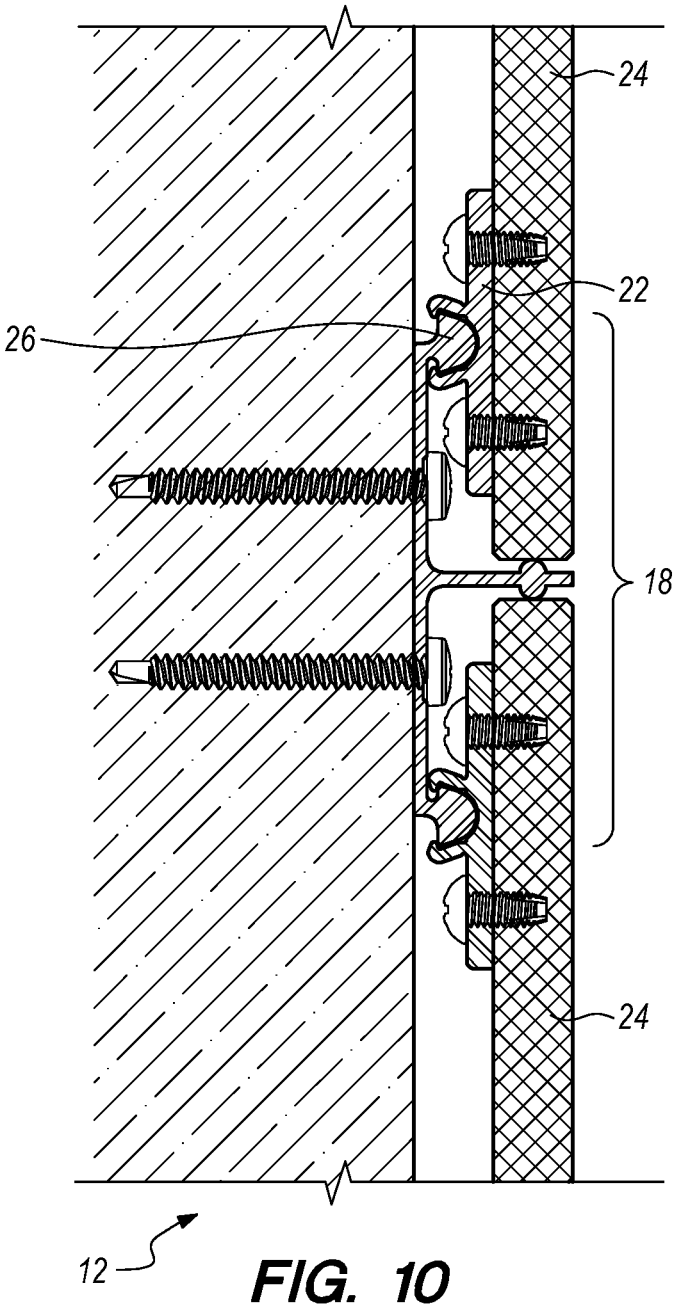
FIG. 10 illustrates a horizontal joint for attaching upper and lower panels to the wall.

The panel 24 shown in FIG. 9 may also have two clips 22 at the lower corners of the panel 24. FIG. 10 illustrates upper and lower panels 24 and the rail 18 that may be used to mount the two lower clips at the lower corners of the panel 24 shown in FIG. 9. The rail 18 may be positioned and mounted to the wall 12 so that the two lower clips 22 mounted the lower corners of the panel 24 may be attached to the protrusion 26. When installing the panel 24 to the wall 12, the protrusion 26 of the rail 18 shown in FIG. 10 and the protrusion 26 of the rail 20 may be inserted into the cavities 34 formed by the hooks 28 of the clips 22 simultaneously or it may be that one of the protrusions 26 are inserted into the cavities 34 of the corresponding clips 22 then the other one of the protrusions 26 is inserted into the cavities 34 of the other corresponding clips 22, or vice versa.

Figure 13:
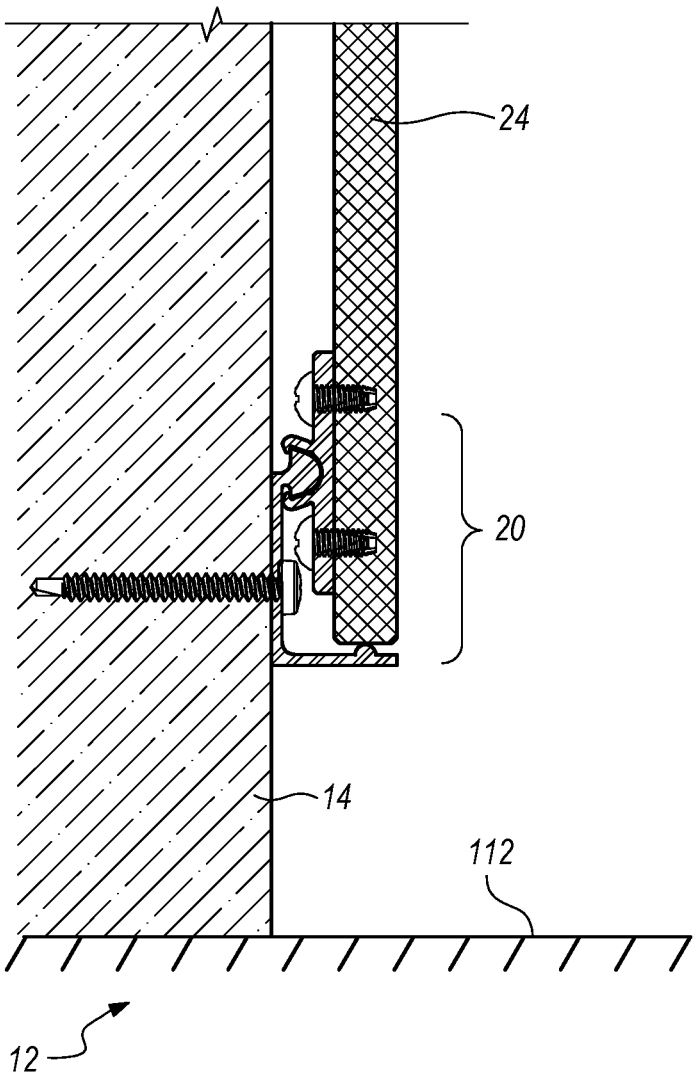
FIG. 13 illustrates a bottom rail for mounting the panel to the wall.

Referring now to FIG. 13, the panel 24 may be mounted near the floor 112 onto the wall 12. The panel 24 is mounted to the wall 12 in the same manner that the panel 12 is mounted to the wall 12 adjacent the ceiling 114. The panel 24 shown in FIG. 13 is gapped away from the floor 112. The same may also be true for the panel 24 mounted adjacent the ceiling 114. The gap between the rail 20 and the floor 112 may be empty to expose the wall surface 14 or may be filled with a base molding or other material if desired. Alternatively, the rail 20 may butt up against the floor.

Figure 11:
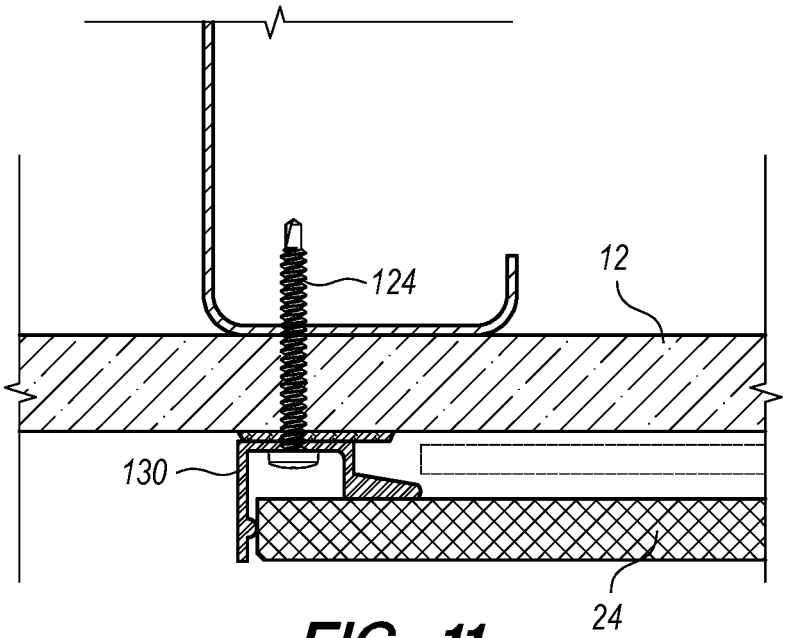
FIG. 11 illustrates a vertical edge detail.

Referring now to FIG. 11, a vertical free edge is shown and how the panel 24 may be mounted to the wall with the vertical free edge is shown. In particular, an extruded finishing piece 130 may be mounted to the wall 12 with screw 124 and be used to hide an edge of the panel 24.

Figure 12:
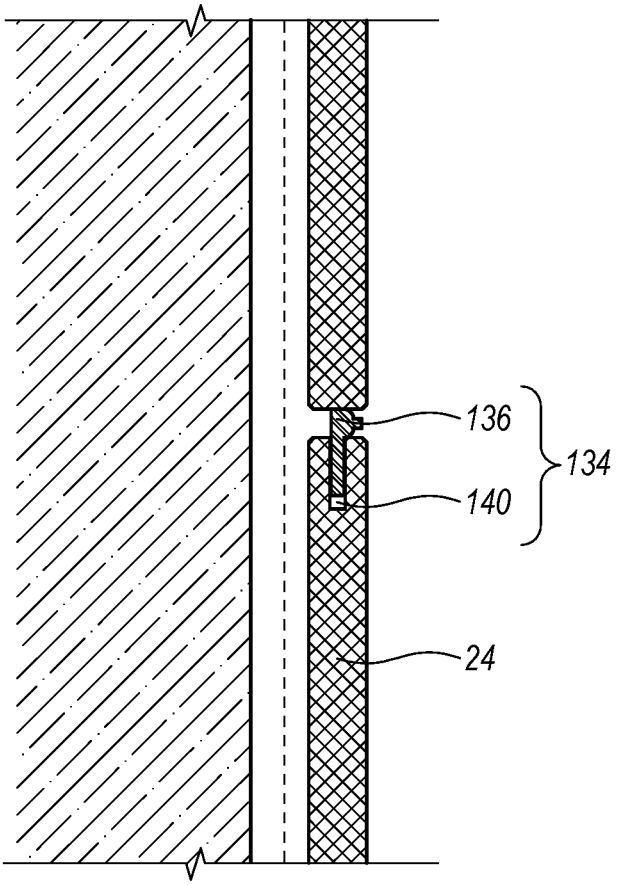
FIG. 12 illustrates a vertical joint detail.

Referring now to FIG. 12, a joint between two panels 24 is shown. The vertical joint 134 may have a finishing piece 136. The finishing piece 136 may be an extruded aluminum piece that may be held in place by inserting the finishing piece 136 into a slot 138 formed on a side of the panel 24. Preferably, the finishing piece 136 is only inserted into a slot of one of the panels 24 but it is also contemplated that the finishing piece 136 may be formed with two tongues that are inserted into two corresponding grooves 140 of both panels 24.

Figure 14:
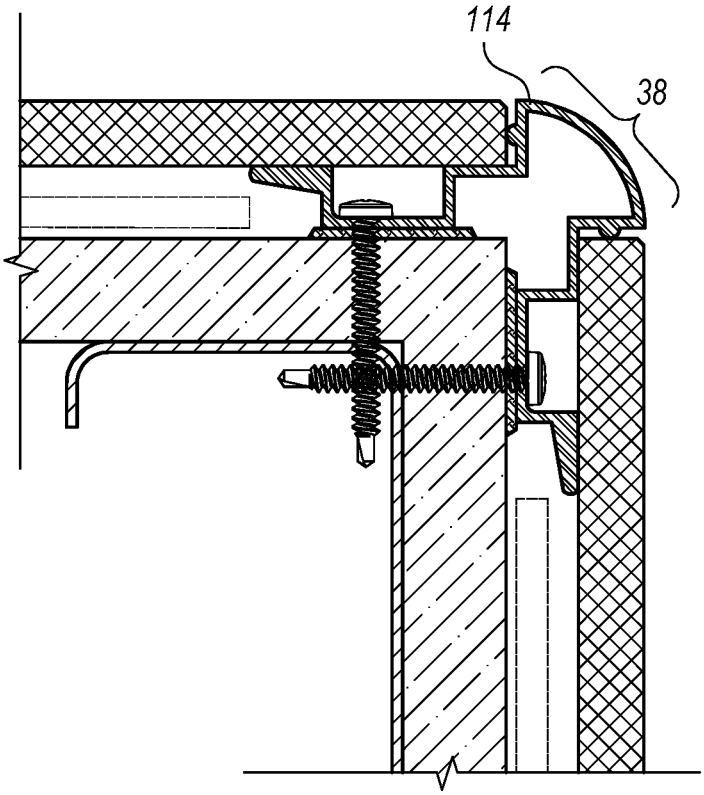
FIG. 14 illustrates a first embodiment of an outside corner.
Figure 15:
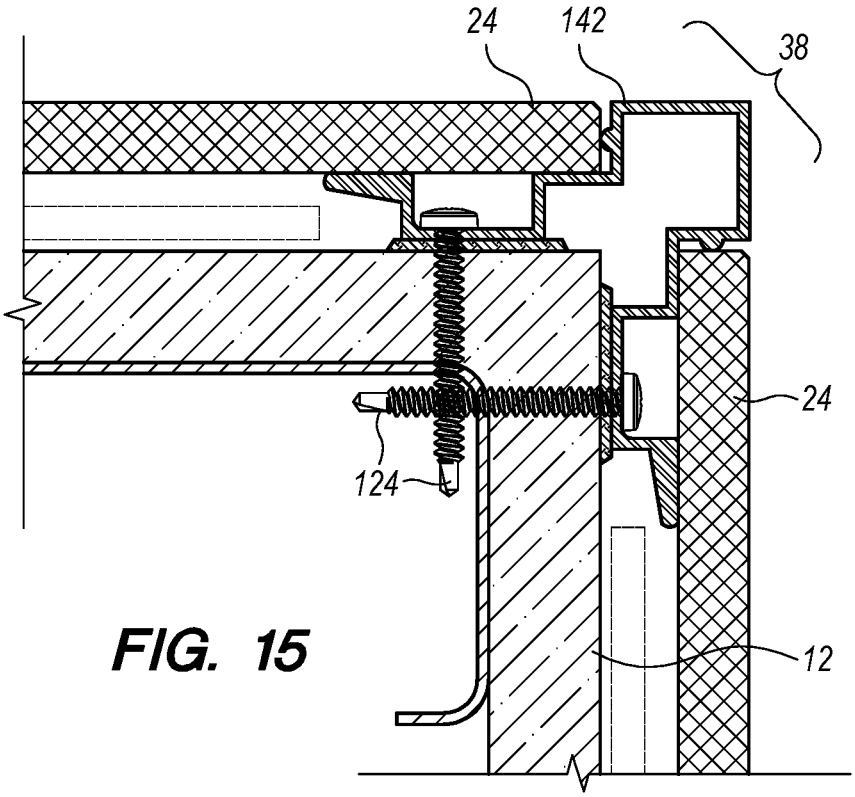
FIG. 15 illustrates a second embodiment of the outside corner.
Figure 16:
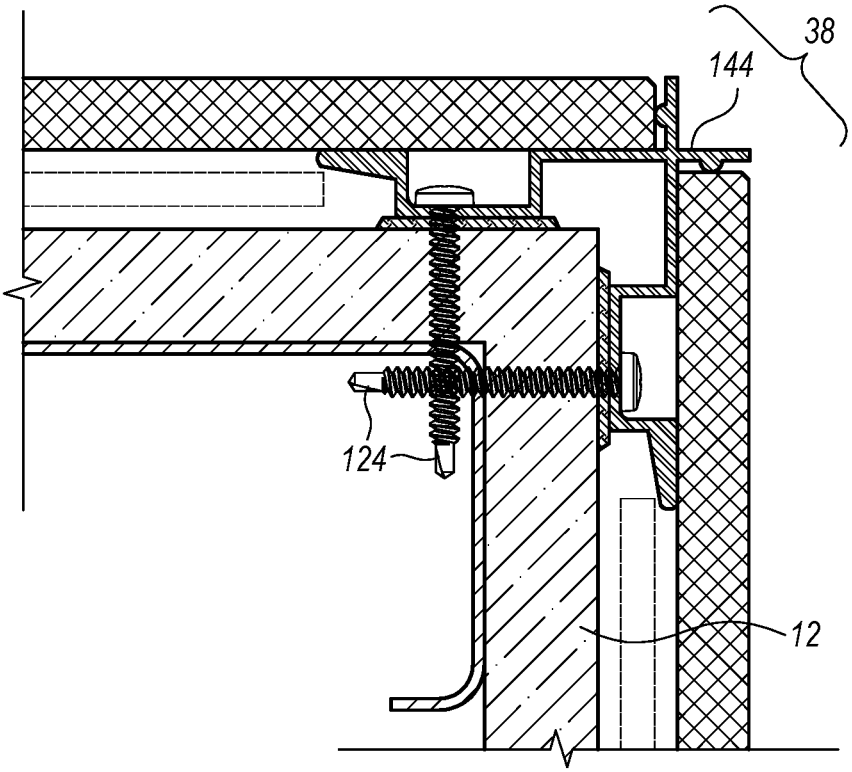
FIG. 16 illustrates a third embodiment of the outside corner.
Figure 17:
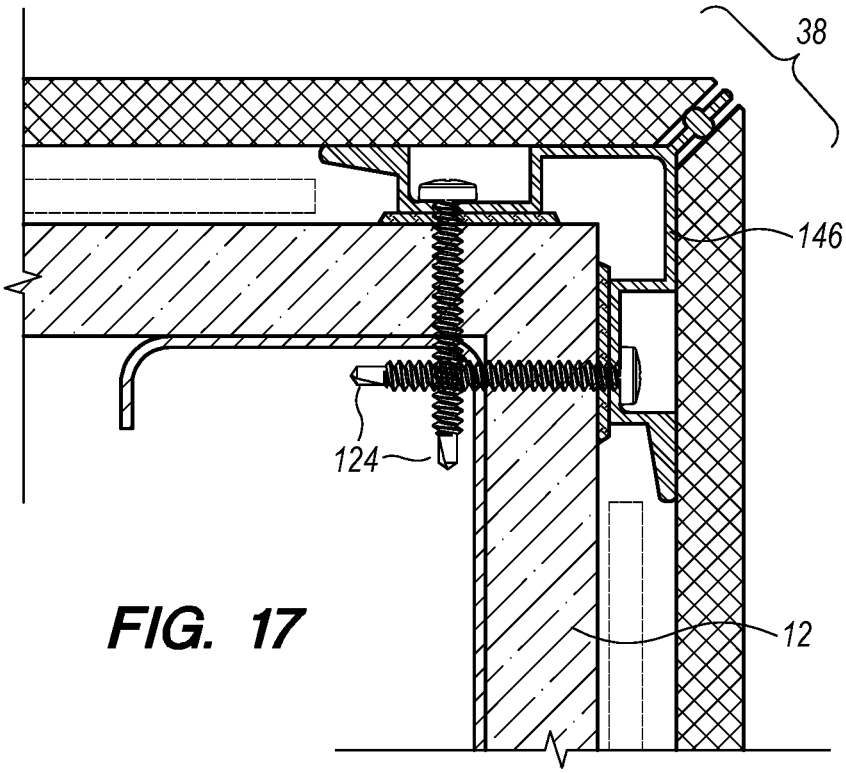
FIG. 17 illustrates a fourth embodiment of the outside corner.

Referring now the FIGS. 14, 16, 17, the outside corner of two panels 24 are shown. The outside corner 38 may have one of three different types of finishing pieces 142, 144, 146 that may be secured to the outside corner of the wall 12 with screws 124.

Figure 18:
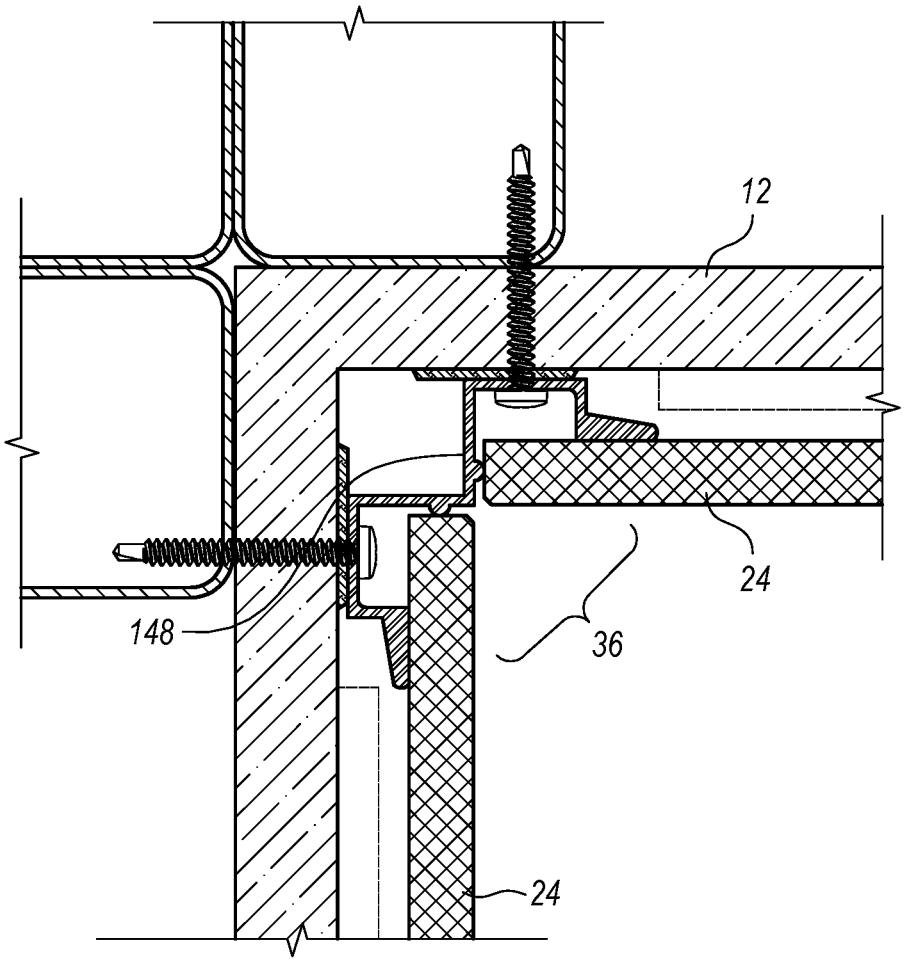
FIG. 18 illustrates an inside corner.

Referring now to FIG. 18, an inside corner 36 of the wall 12 is shown. The finishing piece 148 is used to stabilize the interior edges of the panels 24.

Referring now to FIG. 19, the clip 22 may be mounted to a middle of the panel 24 if needed. If the panel is sufficiently large then the clips 22 would be needed in order to stabilize the panel on the wall 12. To this end, any one of the horizontal rails 16, 18, 20 may be mounted to the wall but in this instance rail 16 is shown.

Figure 20:
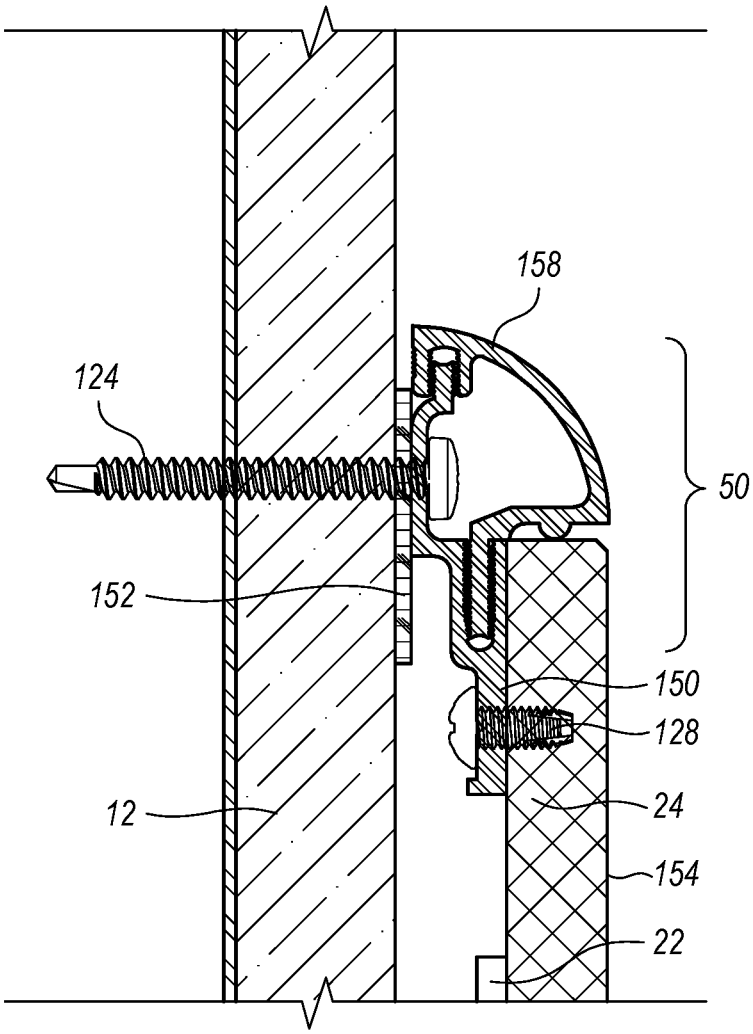
FIG. 20 illustrates a wainscot edge.

Referring now to FIG. 20, the wainscot edge 50 is shown. In lieu of the clip 22 or in addition to the clip 22, a rail 150 may be used to secure the upper edge portion of the panel 24 to the wall 12. The rail 150 may be secured both to the wall 12 and the panel 24 with screws 124, 128. The rail 150 may be shimmed with a shim 152 so that the front surface 154 of the panel 24 appears to be in the same plane or level with the front surfaces 154 of the adjacent panels 24.

FIGS. 9-20 illustrate the mounting of a panel 24 having a thickness 52 of ⅜ of an inch. FIGS. 26-36 illustrate the mounting of a panel 24*a* having a thickness 52*a* of three quarters of an inch. The clips 22 and the horizontal rails 16, 18, 20 and optionally 150 as well as the other components described in relation to FIGS. 9-20 are the same as those in FIGS. 26-36 except as follows. The flange 118*a* of the rail 20*a* is slightly longer and has an additional spacer 126. Additionally, the screws 128 may be replaced with a self threading screw 156. The rail 18*a*, shown in FIG. 27 may have an additional spacer 126. The finishing piece 130*a* may have a longer flange with an extra spacer 126. The finishing piece 136*a* may have additional spacers 126 that provide additional support to the adjacent edges of the panels 24. The finishing pieces 141*a*, 142*a*, 144*a*, 146*a* may have an additional spacer to accommodate the thicker panels 24*a*. The finishing piece 148*a* shown in FIG. 34 may also have an additional spacer to accommodate the thicker panel 24*a*. Additionally, a cap 158*a* attached to the rail 150 may have an additional spacer 126.

To install the face mounting system 10, the panels may be attached to one wall at a time. The installer may install the rail 20 either at the top ceiling 114 or the floor 112. The horizontal joint rail 18, 18*a* may be installed or mounted to the wall surface of the wall at a fixed distance away from the rail 20. The fixed distance may be equal to a fixed distance between the clips 22 at the upper corners of the panel 24 and the clips 22 at the lower corners of the panel 24. More particularly, the protrusion 26 of the rail 20 may be set at a fixed distance to the protrusion 26 of the rail 18, 18*a*. Also, the clip 22 may be set at the fixed distance between the clips 22 at the upper corners of the panel and the clips 22 at the lower corners of the panel 24. In this manner, the panel may be pushed on to the wall 12 so that the protrusions of the rails 18, 18*a* and rail 20 are inserted into the clips 22 at the upper and lower corners of the panel 24. The horizontal rails are mounted to the wall surface 14 so that the protrusions of one rail 18, 18*a* are offset at the fixed distance with respect to the protrusion of the other rail 20. Additional horizontal joint rails 18, 18*a* may be mounted to the wall surface 14 of the wall 12 up to the ceiling or down to the floor depending on how installer started the installation. The last rail to be mounted to the wall surface of the wall 12 may be the rail 20, 20*a*. For larger panels 24, when needed, a mid panel clip 22 may be secured to a middle portion of the panel 24 and the mid panel rail 16 may be secured to the wall surface 14 and the protrusion 26 of the mid panel rail 16, 16*a* may be aligned to the mid panel clip 22 attached to the panel 24. The panels 24 may be manipulated by securing a strong suction cup to a front surface of the panel. The suction cup may have a handle which is held by the installer. When the suction cup is attached to the front surface of the panel, the suction cup is securely attached to the panel. The installer grips the handle of the suction cup and manipulates the panel. The panel may be pushed toward the wall so as to attach the clips and the rails. Moreover, to remove the panel from the wall, the user may attach the suction cup to the panel to be removed. The installer grips the handle of the suction cup and pulls away from the wall in a direction that is perpendicular to the wall surface to which the panel is attached. By perpendicular, the direction of the pull away force generated by the suction cup is about 90 degree with respect to the wall surface plus or minus 25 degrees.

Figure 39:
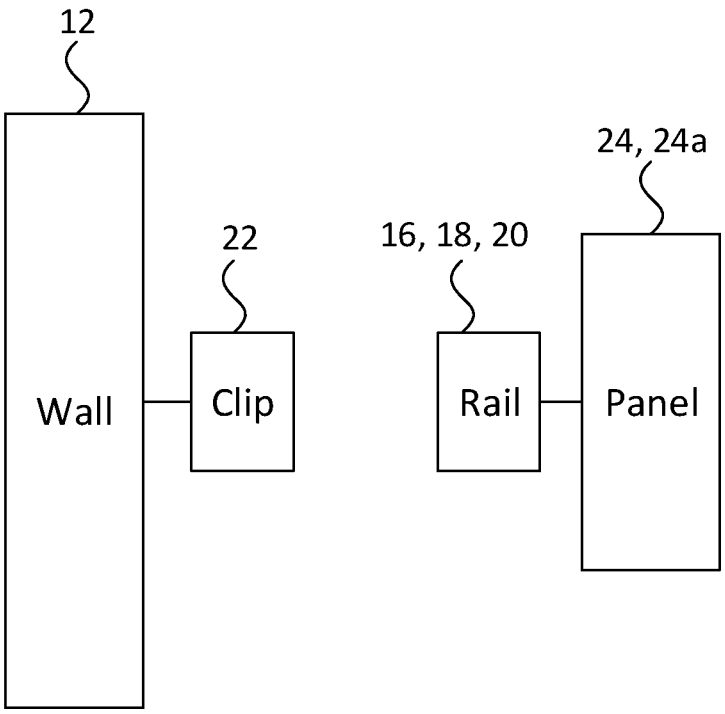
FIG. 39 illustrates an alternative embodiment in which the clips and the rails are attached to the wall and the panels, respectively.

The clips 22 have been described as being attached to the panels 24, 24*a*. Also, the rails 16, 18, 20 have been described as being attached to the wall 12. However, it is also contemplated that the opposite configuration may be utilized wherein the clips 22 are attached to the wall 12 and the rails 16, 18, 20 are attached to the panels 24, 24*a* as shown in FIG. 39. In this instance, the rails 16, 18, 20 may have a length which is shorter than the width of the panels 24, 24*a* and the clips 22 may have a length which is longer than the width of the panels 24, 24*a*.

Moreover, the panels 24, 24*a* has been described as being attached to a vertical wall 12. However, it is also contemplated that the panels 24, 24*a* may be attached to a horizontal or skewed ceiling (e.g. cathedral ceiling) or an exterior or interior wall.

As discussed above, either the clips 22 or the rails 16, 18, 20 are shorter than the width of the panels 24, 24*a*. Preferably, either the clips and/or the rails 16, 18, 20 have a length of about 2⅜" and the panels 24, 24*a* have a width significantly greater than the length of the clips 22 or the rails 16, 18, 20 so that air can flow behind all of the panels 24, 24*a* between the short clips 22 or the short rails 16, 18, 20.

The above description is given by way of example, and not limitation. Given the above disclosure, one skilled in the art could devise variations that are within the scope and spirit of the invention disclosed herein, including various ways of configuring an outer periphery of the panel. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A wall system comprising:

a wall having a flat surface;

a plurality of panels configured to be mountable on the flat surface of the wall, each panel being between 6"×6" and 20"×20" and having a thickness between 5/16" and 1", each panel defining front and back flat surfaces;

a plurality of mounting rails attachable to the flat surface of the wall, each mounting rail having at least one elongate protrusion that defines curved bottom edges facing the flat surface of the wall when the mounting rail is attached to the flat surface of the wall; and a plurality of panel clips attached to the back surface of each of the panels, each clip having a base and opposed elongate hooks, the base extending parallel to and externally in contact with the back surface of one of the panels, each elongate hook having a groove positioned adjacent the base, an arm extending away from the base, and a hook body extending from a distal end of the arm and toward the opposing elongate hook, the opposed elongate hooks being selectively attachable to an elongate protrusion from among the elongate protrusions of the mounting rails, each hook body including a curved surface being disposable in contact with one of the curved bottom edges of the elongate protrusion when the opposed elongate hooks are attached to the elongate protrusion.

2. The wall system of claim 1 wherein only opposed elongate hooks are secured to the elongate protrusion and the panels can be removed with a force perpendicular from the flat surface applied to the panel to be removed so that any one of the panels can be removed without removal of an adjacent panel.

3. The wall system of claim 2 wherein the force is plus or minus 25 degrees from 90 degrees with respect to the flat surface of the wall.

4. The wall system of claim 1 wherein each elongate protrusion extends out perpendicularly relative to the flat surface and being configured so that the panel clips can be removed from or attached to the mounting rails by pulling the panel perpendicularly away from the flat surface or pushing the panel perpendicularly toward the flat surface.

5. The wall system of claim 1 wherein the rails are fabricated from aluminum and the clips are fabricated from plastic.

6. The wall system of claim 1 wherein the opposed elongate hooks of each panel clip are configured to spread apart and go back toward their original position.

7. The wall system of claim 1, wherein each panel includes opposed edges defining a width, each mounting rail including opposed ends defining a length that is greater than ½ the width of the panels.

8. A wall system comprising:

a wall having a flat surface;

a plurality of panels mountable on the flat surface of the wall, each panel being between 6"×6" and 20"×20" and having a thickness between 5/16" and 1", each panel defining front and back flat surfaces;

a plurality of panel clips attached attachable to the flat surface of the wall, each panel clip having opposed elongate hooks configured to spread apart and go back toward their original position, each of the opposed elongate hooks having a groove, an arm extending away from the groove, and a hook body extending from a distal end of the arm and toward the opposing elongate hook, each hook body terminating in a curved surface; and a plurality of mounting rails attached to the back surface of each of the panels, each mounting rail having at least one elongate protrusion attachable to the opposed elongate hooks of the panel clips, each of the at least one elongate protrusions defining curved bottom edges that face the back surface of the panel, the curved bottom edges contacting the curved surfaces of the opposed elongate hooks when the elongate protrusion is attached to the opposed elongate hooks, and any one of the panels being removable from the flat surface of the wall with a pulling force that spreads apart the opposed elongate hooks of a panel clip to which the elongate protrusion of the panel is attached.

9. The wall system of claim 8 wherein only the opposed elongate hooks are engageable to the elongate protrusion and the panels can be removed with a force perpendicular from the flat surface applied to the panel to be removed so that any one of the panels can be removed without removal of an adjacent panel.

10. The wall system of claim 9 wherein the force is plus or minus 25 degrees from 90 degrees with respect to the flat surface of the wall.

11. The wall system of claim 8 wherein the elongate protrusion extends toward and perpendicular to the flat surface and is configured so that the panel clips can be removed from or attached to the mounting rails by pulling the panel perpendicularly away from the flat surface or pushing the panel perpendicularly toward the flat surface.

12. The wall system of claim 8 wherein the rails are fabricated from aluminum and the clips are fabricated from plastic.

13. The wall system of claim 8, wherein each panel includes opposed edges defining a width, each mounting rail including opposed ends defining a length that is greater than ½ the width of the panels.

14. A method of installing a face mounting system to a wall, the method comprising the steps of:

attaching a first elongate rail to a flat surface of the wall, the first elongate rail having a first protrusion which is straight;

aligning a second elongate rail having a second protrusion which is straight parallel to the first protrusion;

attaching the second elongate rail to the flat surface of the wall while holding the alignment achieved during the aligning the second elongate rail step;

aligning and attaching additional elongate rails to the flat surface of the wall so that protrusions of the additional elongate rails are parallel to the first and second protrusions of the first and second elongate rails;

positioning upper and lower clips with a base of each of the upper and lower clips extending parallel to and externally in contact with a back surface of each panel of a plurality of panels, each upper and lower clip including a groove positioned adjacent the base, an arm extending from the groove and away from the base, and a hook body extending from a distal end portion of the arm;

attaching the upper and lower clips to the plurality of panels via the bases, a distance between the upper and lower clips being equal to a distance between the first protrusion of the first elongate rail and the second protrusion of the second elongate rail so that the upper and lower clips are attachable to adjacent elongate protrusions.

15. The method of claim 14 further comprising the step of attaching a suction cup with a handle to a front surface of the panel to hold the panel while pushing the panel toward the wall for attaching the upper and lower clips attached to the panel to corresponding rails attached to the flat surface of the wall.

16. The method of claim 14 wherein each of the upper and lower clips include opposed hooks configured to spread apart and go back toward their original position.

17. The method of claim 16 further comprising spreading apart the opposed hooks by pushing the first protrusion or the second protrusion between the opposed hooks.

18. The method of claim 17 further comprising pushing the first protrusion or the second protrusion into a cavity between the opposed hooks to allow the opposed hooks to go back toward their original position.

* * * * *